US010617272B2

(12) United States Patent
Takaki

(10) Patent No.: US 10,617,272 B2
(45) Date of Patent: Apr. 14, 2020

(54) SQUEEGEE AND COMPONENT OF SAME

(71) Applicant: Masahiro Takaki, Musashino (JP)

(72) Inventor: Masahiro Takaki, Musashino (JP)

( * ) Notice: Subject to any disclaimer, the term of this patent is extended or adjusted under 35 U.S.C. 154(b) by 231 days.

(21) Appl. No.: 15/377,159

(22) Filed: Dec. 13, 2016

(65) Prior Publication Data

US 2017/0181589 A1 Jun. 29, 2017

(30) Foreign Application Priority Data

Dec. 28, 2015 (JP) ..... 2015/256104

(51) Int. Cl.

| | |
|---|---|
| ***A47L 13/11*** | (2006.01) |
| ***A47L 1/06*** | (2006.01) |
| ***A47L 13/44*** | (2006.01) |
| ***A47L 13/12*** | (2006.01) |
| ***A47L 1/15*** | (2006.01) |

(52) U.S. Cl.

CPC ..... *A47L 13/11* (2013.01); *A47L 1/06* (2013.01); *A47L 1/15* (2013.01); *A47L 13/12* (2013.01); *A47L 13/44* (2013.01)

(58) Field of Classification Search

CPC ..... A47L 1/06; A47L 1/12; A47L 1/13; A47L 13/11; A47L 13/12

See application file for complete search history.

(56) References Cited

U.S. PATENT DOCUMENTS 3,110,052 A * 11/1963 Whitman ..... A47L 13/12 15/117

FOREIGN PATENT DOCUMENTS

| | | | | |
|---|---|---|---|---|
| DE | 3308490 | * | 9/1984 | ..... A47L 1/06 |
| GB | 2005994 | A | 5/1979 | |
| JP | S49-135252 | U | 11/1974 | |
| JP | S52-139670 | U | 10/1977 | |
| JP | S54-114467 | U | 8/1979 | |
| JP | 2010-213732 | | 9/2010 | |
| JP | 2012-040066 | | 3/2012 | |

OTHER PUBLICATIONS

U.S. Appl. No. 15/311,707 to Masahiro Takaki, filed Nov. 16, 2016.
Office Action issued in Japan Counterpart Patent Appl. No. 2015-256104, dated Nov. 27, 2018, along with an English language translation thereof.

* cited by examiner

*Primary Examiner* — Laura C Guidotti
(74) *Attorney, Agent, or Firm* — Greenblum & Bernstein, P.L.C.

(57) ABSTRACT

This invention enables attachment of a washer to a squeegee head in a state in which the handle head and a back plate are joined to each other. A squeegee includes a handle, a back plate and a channel. The handle includes a handle head and a grip. A channel is clamped between the handle head and the back plate. A part of the squeegee on a front end side relative to the grip, the part excluding the channel, is referred to as a squeegee head. The squeegee includes a washer attachment portion which enables attachment of a washer to the squeegee head in a state in which the back plate is attached to the handle head. The washer attachment portion is disposed in an area of the squeegee head, the area being off an area in which the handle head and the back plate overlap each other.

18 Claims, 25 Drawing Sheets

SQUEEGEE AND COMPONENT OF SAME

The disclosure of Japanese Patent Application No. JP2015-256104 filed on Dec. 28, 2015 including the specification, drawings, claims and abstract is incorporated herein by reference in its entirety.

BACKGROUND OF THE INVENTION

1. Field of the Invention

This invention relates to a squeegee, which is a glass window cleaning tool, and a component of the same.

2. Description of the Related Art

Japanese Patent Laid-Open Nos. 2010-213732 and 2012-040066 each describe a technique of attaching a washer to a squeegee head.

With each of the specific structures described in Japanese Patent Laid-Open No. 2010-213732 and No. 2012-040066 as embodiments, a washer cannot be attached to a squeegee head in a state in which a handle head and a back plate are joined to each other.

This invention provides a squeegee that enables attachment of a washer to a squeegee head in a state in which a handle head and a back plate are joined to each other, and a component of the same.

SUMMARY OF THE INVENTION

A squeegee according to this invention is a squeegee including a handle that includes a handle head on a front end side and a grip on a rear end side, and a back plate attached to a front side (ventral side) of the handle head, a channel holding a rubber and clamped between the handle head and the back plate, assuming that a part of the squeegee on the front end side relative to the grip, the part excluding the channel, is referred to as a squeegee head, the squeegee including a washer attachment portion that enables attachment of a washer to the squeegee head in a state in which the back plate is attached to the handle head, wherein the washer attachment portion is disposed in an area of the squeegee head, the area being off an area in which the handle head and the back plate overlap each other (for example, the area being on opposite, right and left, sides relative to the area in which the handle head and the back plate overlap each other). Accordingly, the washer can be attached to the squeegee head via the washer attachment portion in a state in which the handle head and the back plate are joined to each other.

In the squeegee according to this invention, it is possible that the washer attachment portion includes a screw passing hole that allows a screw for attaching the washer to the squeegee head, to be inserted therethrough, or a threaded hole that allows the screw to be screwed thereinto. Accordingly, the washer can be attached to the squeegee head via the screw.

A washer attachment component according to this invention is a component including the above washer attachment portion, and the washer attachment component is attached to the squeegee head. Accordingly, the washer attachment component is attached to the squeegee head of the squeegee having a structure that allows attachment of the back plate to the handle head, whereby the washer attachment portion is formed in the squeegee head, enabling attachment of the washer to the squeegee head. Also, if there are plural types of squeegees whose respective structures that allow attachment of the back plate to the handle head are mutually different (for example, different in a distance between two screws for screwing the back plate to the handle head), a washer of a same type can be attached to each of the plural types of squeegees by replacement of the washer attachment part.

In the washer attachment component according to this invention, it is possible that the washer attachment component includes a squeegee attachment portion that enables attachment of the washer attachment component to the squeegee head, in addition to the washer attachment portion; and the washer attachment portion enables attachment of the washer to the washer attachment component in a state in which the washer attachment component is attached to the squeegee head via the squeegee attachment portion. Accordingly, the washer attachment component is attached to the squeegee head via the squeegee attachment portion, enabling attachment of the washer to the squeegee head via the washer attachment portion in a state in which the handle and the back plate of the squeegee are joined to each other.

It is possible that: the washer attachment component includes right and left extensions forming respective areas extending on opposite, right and left, sides of the handle head and the back plate, respectively, in a state in which the washer attachment component is attached to the squeegee head; and each of the right and left extensions includes the washer attachment portion. Accordingly, the washer attachment portion is disposed at each of respective positions on the opposite, right and left, sides of the squeegee head, enabling easy attachment of the washer to the squeegee head without being hindered by the squeegee. Also, a structure that enables attachment of the washer to either of the front side (ventral side, that is, surface side the rubber faces) and the back side (dorsal side) of the squeegee that can be switched each other can easily be provided.

It is possible that the washer attachment component includes a structure that allows attachment of the washer attachment component to the squeegee along with attachment of the back plate to the handle head. Accordingly, along with attachment of the back plate to the handle head via an attachment element (e.g., a screw), the washer attachment component can be attached to the squeegee, which can eliminate the need for a dedicated attachment element for attachment of the washer attachment component to the squeegee.

It is possible that the washer attachment component enables attachment of the washer to either of the front side and the back side of the squeegee head that can be switched each other. Accordingly, either of two usage modes can be set in such a manner that the usage mode can be switched from one to the other. In one of the usage modes, the washer is disposed on the front side of the squeegee to perform washing via the washer and water removal via the squeegee at a time. In the other usage mode, the washer is disposed on the back side of the squeegee to perform either of washing via the washer and water removal via the squeegee, which can be switched each other by reversing the handle axially.

It is possible that the washer attachment component is attached to the squeegee in such a manner that the washer attachment component is disposed on a back side of the handle head that is a surface side opposite to a surface of the handle head, the surface facing the back plate, is disposed between the handle head and the back plate or is disposed on a front side of the back plate that is a surface side opposite to a surface of the back plate, the surface facing the handle head.

This invention enables the washer attachment portion to be provided in the handle, which is a component of the squeegee. Accordingly, the washer can directly be attached to the handle, which can eliminate the need for an independent washer attachment component including a washer attachment portion.

This invention enables the washer attachment portion to be disposed in the back plate, which is a component of the squeegee. Accordingly, a washer can directly be attached to the back plate, which can eliminate the need for an independent washer attachment component including a washer attachment portion.

Also, a washer attachment component according to this invention is a washer attachment component for, upon being attached to a squeegee, enabling attachment of a washer to the squeegee, the washer attachment component including: a squeegee attachment portion that enables attachment of the washer attachment component to the squeegee in a state in which the washer is not attached to the washer attachment component; and a washer attachment portion that enables attachment of the washer to the washer attachment component in a state in which the washer attachment component is attached to the squeegee via the squeegee attachment portion. According to this, the washer can be attached to the washer attachment component via the washer attachment portion in a state in which the washer attachment component is attached to the squeegee via the squeegee attachment portion, and thus, the washer can be attached to the squeegee head via the washer attachment portion in a state in which the handle head and the back plate are joined to each other. Also, a washer of a same type can be attached to each of plural types of squeegees that are mutually different in structure, by replacement of the washer attachment component.

DETAILED DESCRIPTION OF THE PREFERRED EMBODIMENTS

Embodiment 1

Figure 2:
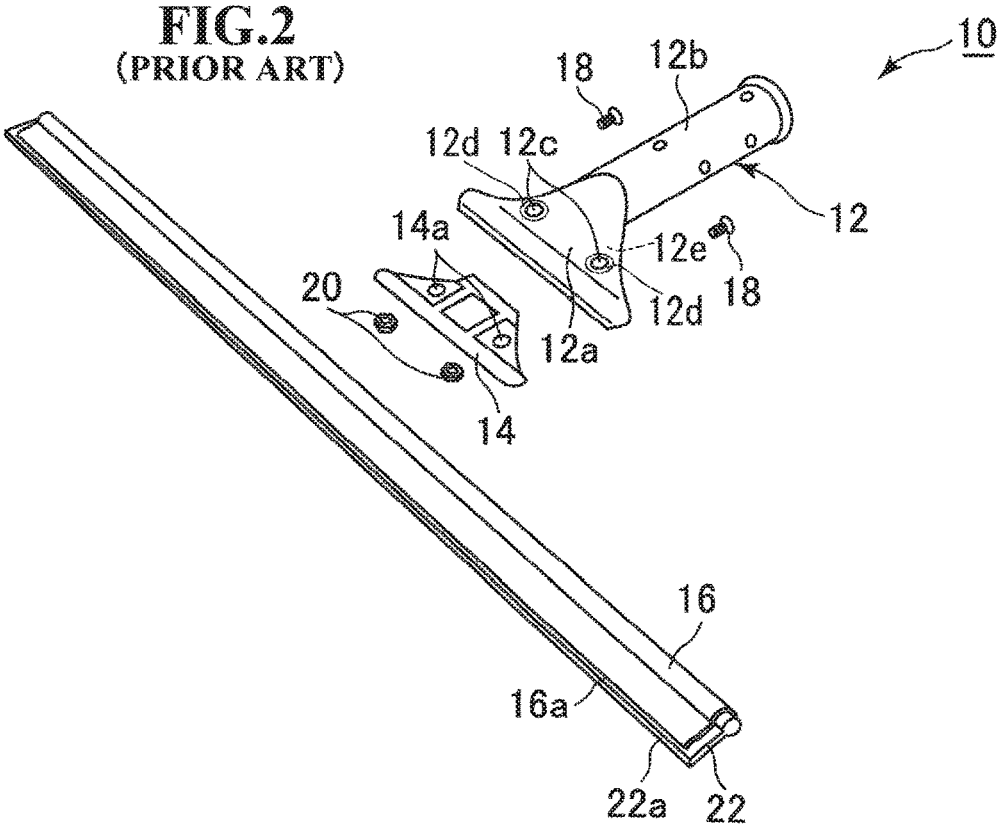
FIG.2 (PRIOR ART)
FIG. 2 is a diagram illustrating components of a conventional squeegee, which is a perspective view of the squeegee as dissembled and viewed from the back side.
Figure 3A:
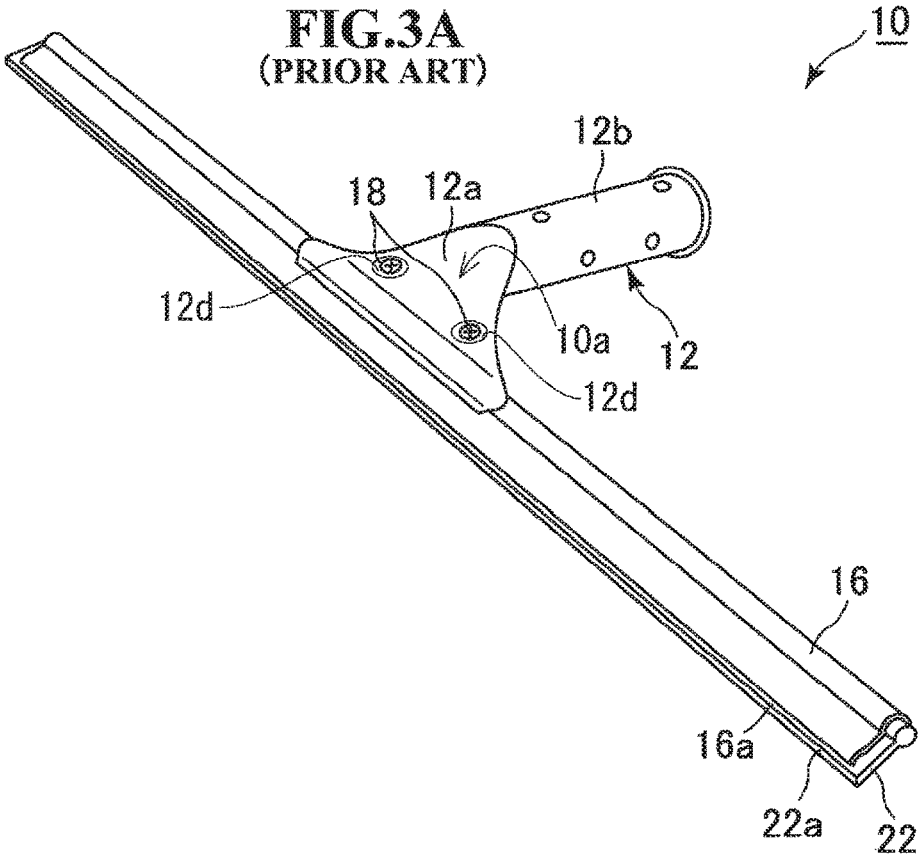
FIG.3A (PRIOR ART)
FIG. 3A is a perspective view of the squeegee in FIG. 2 as assembled and viewed from the back side.
Figure 3B:
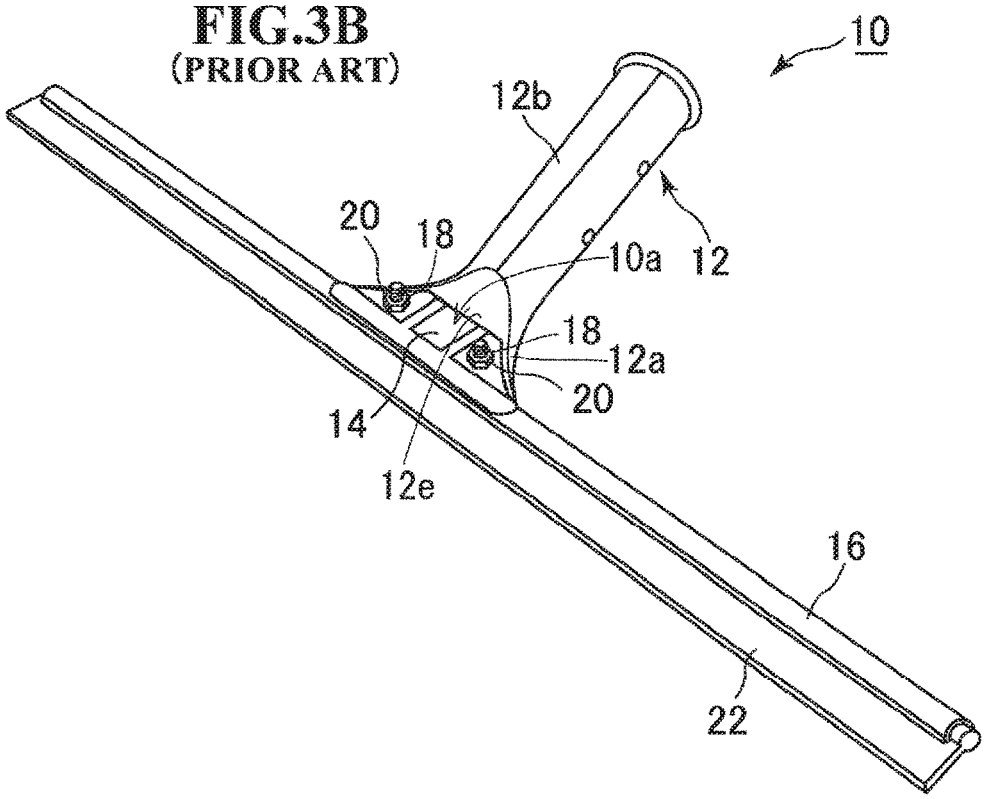
FIG.3B (PRIOR ART)
FIG. 3B is a perspective view of the squeegee in FIG. 3A as viewed from the front side.

Embodiment 1 of this invention will be described. This embodiment provides a squeegee according to this invention, which is obtained by attachment of a washer attachment component according to this invention to a conventional squeegee and thereby enables a washer to be removably attached thereto. First, a conventional squeegee used in this embodiment will be described with reference to FIGS. 2, 3A and 3B. FIG. 2 illustrates components of a conventional squeegee 10. FIG. 2 indicates a case where a handle and a back plate of a "Master Squeegee" manufactured by Ettore Products Company is used. Other companies also have handles and back plates of a type similar to the above. The squeegee 10 is formed of a handle (gripper) 12 of a metal, a back plate 14 of a metal, a channel (transverse bar) 16 of a metal, two screws 18, two nuts 20, and a rubber (long elastic plate of, e.g., rubber) 22 fitted on the channel 16 along a longitudinal direction (long direction) thereof. Here, of the respective opposite sides of the squeegee 10 and the components thereof, the side facing a glass window when the glass window is rubbed (water is removed) with the squeegee 10 is referred to as "front side", and the side opposite to that side is referred to as "back side". Also, in a front-rear direction of the squeegee 10 (that is, an axis direction of the handle 12), the side on which the channel 16 is disposed is referred to as "front end side", and the side opposite to that side (a terminal side of the grip 12*b*) is referred to as "rear end side". The handle 12 includes a handle head 12*a* on the front end side and a grip 12*b* on the rear end side. The grip 12*b* is formed so as to have a round shape in a cross-section perpendicular to the axis so that the grip 12*b* can easily be grasped for work. The handle head 12*a*, which is continuous with a front end of the grip 12*b*, is formed in a flat and wide shape that widens toward the front end side like a fan. In the handle head 12*a*, a recess 12*d* is formed at each of two places of right and left. At a center of each recess 12*d*, a screw passing hole 12*c* is formed. The back plate 14 is formed in a fan-like shape of a size that allows the back plate 14 to be received in a depression 12*e* on the back side (front side) of the handle head 12*a*. In the back plate 14, a screw passing hole 14*a* is formed at each of two places facing the two screw passing holes 12*c* of the handle head 12*a*. A procedure for assembling the handle 12, the back plate 14 and the channel 16 is as follows. The back plate 14 is received in the depression 12*e* on the front side of the handle head 12*a*. The channel 16 is put into a front end between the handle head 12*a* and the back plate 14. The two screws 18 are inserted into the screw passing holes 12*c* and 14*a* sequentially from the back side of the handle 12. The nuts 20 are screwed and fastened to respective ends of the screws 18, the ends projecting on the front side of the back plate 14. Consequently, the handle 12 and the back plate 14 are joined to each other, and the channel 16 is clamped by the front end between the handle head 12*a* and the back plate 14, whereby the handle 12, the back plate 14 and the channel 16 are assembled and integrated in such a manner that disassembling is possible. FIGS. 3A and 3B illustrate the squeegee 10 assembled as described above, as viewed from the back side and the front side, respectively. A front edge 22*a* of the rubber 22 slightly projects from a front edge 16*a* of the channel 16 so as to be able to rub a wash solution off from a surface of a glass window. A part of the squeegee 10 on the front end side relative to the grip 12*b*, the part excluding the channel 16, is here referred to as "squeegee head 10*a*".

Figure 4:
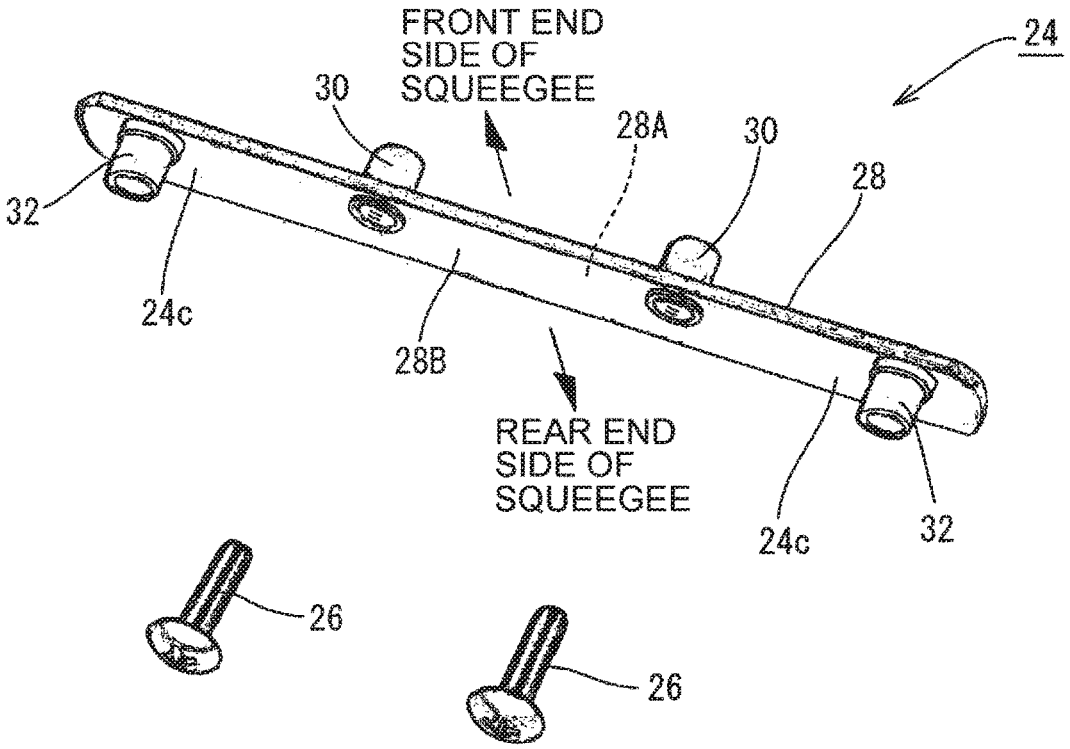
FIG. 4 is a diagram illustrating Embodiment 1 of a washer attachment component according to this invention, which is a perspective view illustrating a washer attachment component to be attached to the squeegee in FIG. 2 for use and screws used for the attachment.

FIG. 4 illustrates a washer attachment component 24 to be attached to the squeegee 10 in FIG. 2 for use and screws 26 to be used for the attachment. The screws 26 are used instead of the screws 18 in FIG. 2 and shafts of the screws 26 are longer than those of the screws 18. The nuts 20 in FIG. 2 are not used here. The washer attachment component 24 is formed by attaching two female threaded rivets 30 and 30 that are hollow (that is, include a through hole) and two non-female threaded rivets 32 and 32 that are hollow (that is, include a through hole) to respective different positions in a plate 28 forming a washer attachment component body. The plate 28 is formed of, for example, a metal plate (flat plate) of, e.g., aluminum having a length of around 11 cm, a width of around 2 cm and a thickness of around 2 mm. The female threaded rivets 30 and 30 each form a squeegee attachment portion, and are disposed with a center position in a longitudinal direction of the plate 28 therebetween, at respective positions equally distant from the center position. A distance between axes of the female threaded rivets 30 and 30 is equal to a distance between axes of the two screw passing holes 12*c* and 12*c* (FIG. 2) of the handle head 12*a* and also to a distance between axes of the two screw passing holes 14*a* and 14*a* (FIG. 2) of the back plate 14. The non-female threaded rivets 32 and 32 each form a washer attachment portion, and is disposed with the center position in the longitudinal direction of the plate 28 therebetween, at respective positions that are equally distant from the center position (positions at which a distance from the center position in the longitudinal direction of the plate 28 is longer than that of the female threaded rivets 30 and 30, the positions being close to respective opposite ends in the longitudinal direction of the plate 28). At a position of the washer attachment component 24 attached to the squeegee 10, the non-female threaded rivets 32 and 32 are disposed on opposite, right and left, sides of the handle head 12*a* across the handle head 12*a*. A distance between axes of the non-female threaded rivets 32 and 32 is set so as to have such a distance. The female threaded rivets 30 and the non-female threaded rivets 32 project on respective sides opposite to each other in the plate thickness direction of the plate 28. Here, of opposite surfaces 28A and 28B in the plate thickness direction of the plate 28, a surface on the side on which the female threaded rivets 30 and 30 project is referred to as "surface 28A" and a surface on the side on which the non-female threaded rivets 32 project is referred to as "surface 28B". The washer attachment component 24 is supported on the squeegee head 10*a* by bringing the surface 28B into abutment with the back side or the front side of the squeegee head 10*a*. As an alteration of the configuration in FIG. 4, it is possible to provide screw passing holes at respective positions in the plate 28 at which the female threaded rivets 30 and 30 are to be attached, use the nuts 20 and 20 in FIG. 2 instead of the female threaded rivets 30 and 30 and insert the screws 26 and 26 through the respective screw passing holes, screw the screws 26 and 26 into the nuts 20 and 20 and fasten the screws 26 and 26.

Figure 1A:
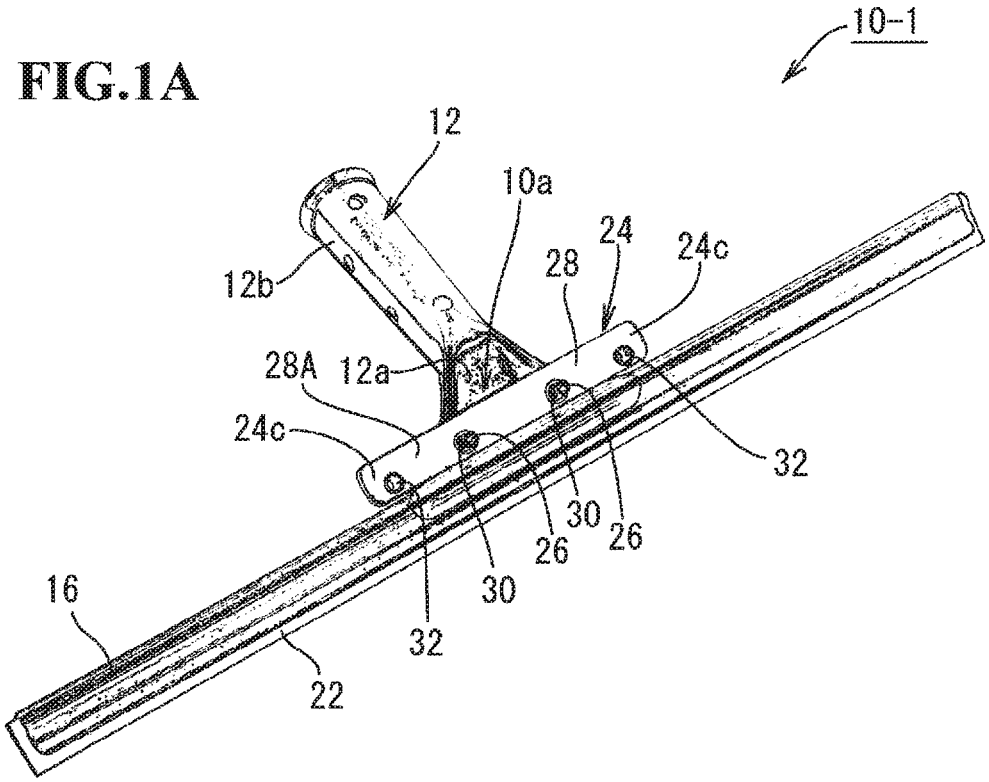
FIG. 1A is a diagram illustrating Embodiment 1 of a squeegee according to this invention, which is a perspective view of a washer attachment component-equipped squeegee with the washer attachment component in FIG. 4 attached to the back side of the squeegee in FIG. 2, as viewed from the back side.
Figure 1B:
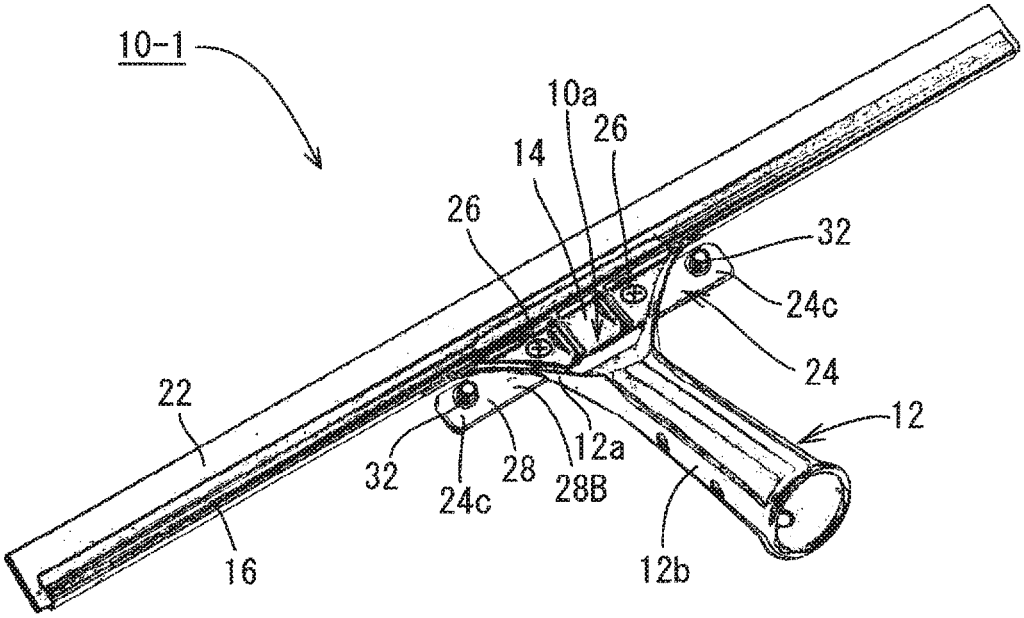
FIG. 1B is a perspective view of the washer attachment component-equipped squeegee in FIG. 1A as viewed from the front side.

FIG. 1A (state as viewed from the back side) and FIG. 1B (state as viewed from the front side) illustrate the washer attachment component 24 in FIG. 4 attached to the back side of the squeegee 10 in FIG. 2. In this washer attachment component-equipped squeegee 10-1, the long screws 26 in FIG. 4 are used instead of the short screws 18 in FIG. 2. Also, the female threaded rivets 30 and 30 in FIG. 4 are used instead of the nuts 20 in FIG. 2. A procedure for assembling the washer attachment component-equipped squeegee 10-1 in FIGS. 1A and 1B is as follows. The back plate 14 is received in the depression 12*e* on the front side of the handle head 12*a*. The channel 16 is put into the front end between the handle head 12*a* and the back plate 14. So far, the procedure is the same as the procedure for assembling the conventional squeegee 10 in FIG. 2. Next, the surface 28B of the washer attachment component 24 is brought into abutment with the back side of the handle head 12*a* and the washer attachment component 24 is mounted on the back side of the handle head 12*a*. The two screws 26 are sequentially inserted into the respective screw passing holes 14*a* and 12*c* from the front side of the back plate 14 and screwed into the respective female threaded rivets 30 of the washer attachment component 24 and fastened. Consequently, the back plate 14, the handle 12 and the washer attachment component 24 are joined to one another, and the channel 16 is clamped by the front end between the handle head 12*a* and the back plate 14. As described above, the washer attachment component 24, the handle 12, the back plate 14 and the channel 16 are assembled and integrated as in FIGS. 1A and 1B in such a manner that disassembling is possible. Consequently, the washer attachment component-equipped squeegee 10-1 including the washer attachment component 24 attached to the squeegee head 10*a* is configured. Here, parts on the opposite sides in the longitudinal direction of the washer attachment component 24 extend on the opposite, right and left, sides from an area of the squeegee head 10*a* in which the handle head 12*a* and the back plate 14 are present and thus form right and left extensions 24*c* and 24*c*. The extensions 24*c* and 24*c* each form a part of the squeegee head 10*a*. The right and left extensions 24*c* and 24*c* are disposed outside the area of the squeegee head 10*a* in which the handle head 12*a* and the back plate 14 overlap each other. In the extensions 24*c* and 24*c*, the respective non-female threaded rivets 32 and 32, which each form a washer attachment portion, are disposed so as to project on the front side of the washer attachment component-equipped squeegee 10-1. Also, the washer attachment component-equipped squeegee 10-1 can be used alone as a simple squeegee without attaching a washer thereto, for removing water from a glass window. In this case, the washer attachment component 24 is not an obstacle to the water removal work.

Figure 5:
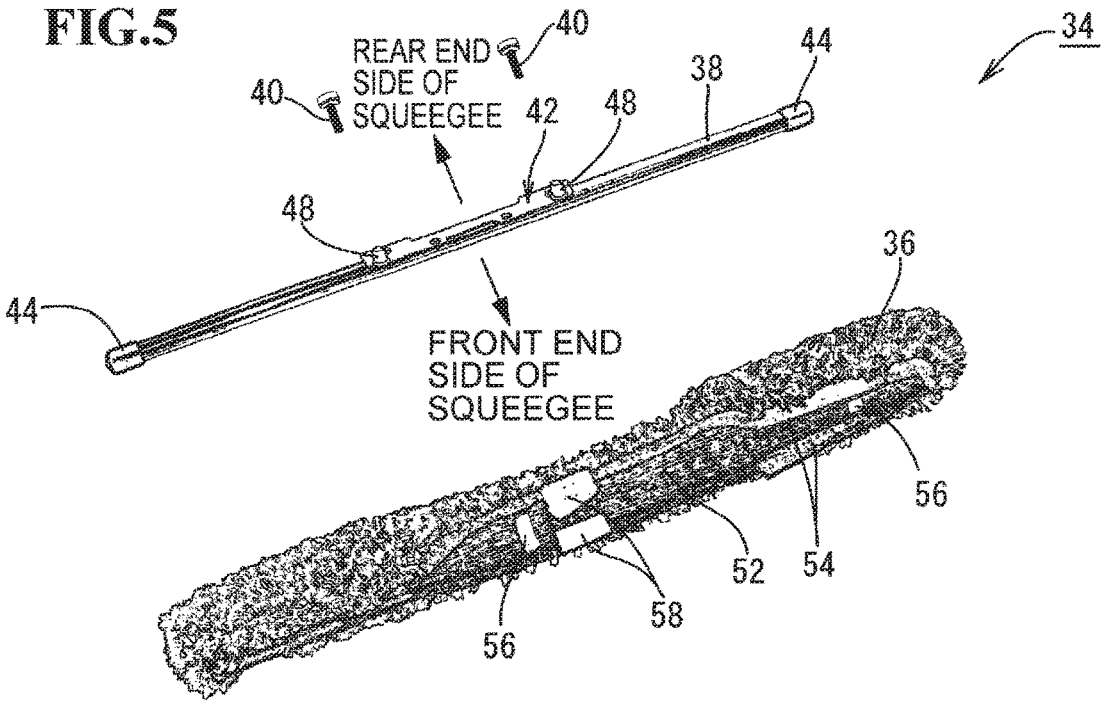
FIG. 5 is an exploded perspective view illustrating a washer that is removably attachable to either of the back side and the front side of any of the squeegees according to Embodiments 1 to 4, and hand screws for attaching the washer to a washer attachment component-equipped squeegee.

A washer that is removably attachable to either of the back side and the front side of the washer attachment component-equipped squeegee 10-1 in FIGS. 1A and 1B will be described. FIG. 5 illustrates an exploded perspective view of a washer 34 such as above. The washer 34 includes an impregnation body 36 and a rod-like (straight rod-like) core member 38. Two hand screws 40 and 40 are screws for attaching the washer 34 to the washer attachment component-equipped squeegee 10-1. On the core member 38, a support base 42 is attached at a center in a longitudinal direction of the core member 38, via, e.g., rivets. The core member 38 is formed of, for example, a round aluminum pipe (straight pipe) having a diameter of around 10 mm and a length that is substantially the same as that of the channel 16 (FIGS. 1A and 1B). Each of opposite ends of the core member 38 is covered by and thereby fitted with a cap 44 of, e.g., vinyl or rubber.

Figure 6:
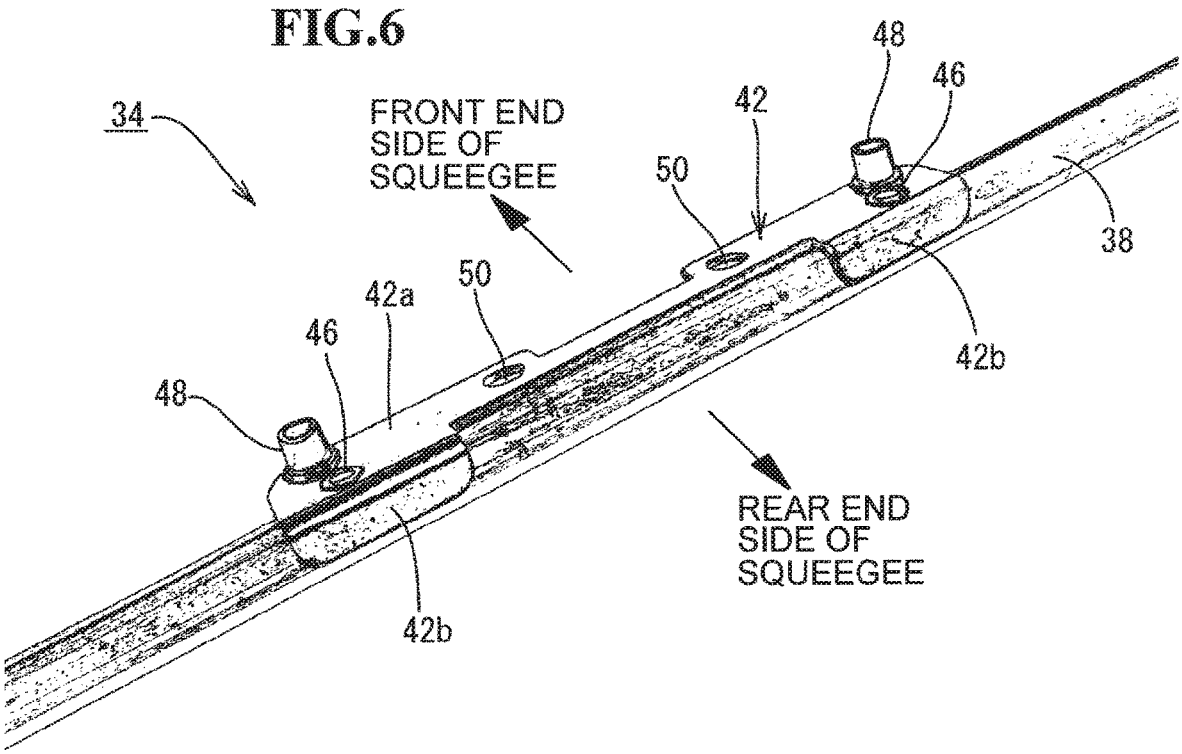
FIG. 6 is an enlarged perspective view of a part around a support base 42 of the washer in FIG. 5.

A configuration of the support base 42 will be described with reference to the enlarged view in FIG. 6. The support base 42 is formed of, for example, an aluminum plate having a thickness of around 1.5 mm. The support base 42 includes a base portion 42*a*, and backs 42*b* and 42*b*, which are bent at right angle relative to the base portion 42*a* at respective positions around opposite ends in a longitudinal direction of the base portion 42*a*. The core member 38 is fixed to the base portion 42*a* via two blind rivets (drawing rivets) 46 in a state in which the core member 38 is supported by respective inner surfaces of the base portion 42*a* and the backs 42*b* and 42*b*. In the base portion 42*a*, female threaded rivets 48 and 48 that are hollow (that is, include a through hole) are attached at respective positions close to the opposite ends in the longitudinal direction of the base portion 42*a*. In other words, the female threaded rivets 48 are attached to the base portion 42*a* so as to project at right angle from a surface of the base portion 42*a* toward the side opposite to the side on which the core member 38 is disposed. In a surface of a projecting distal end of each female threaded rivet 48, a female threaded opening is formed. An outer diameter of the female threaded rivets 48 is equal to that of the non-female threaded rivets 32 of the washer attachment component 24 (FIG. 4). Also, a distance between axes of the two female threaded rivets 48 and 48 is equal to the distance between the axes of the non-female threaded rivets 32 and 32 of the washer attachment component 24. In any usage in Embodiment 1 and an alteration of Embodiment 1 and Embodiments 2 and 3, which will be described later, the washer 34 is attached to a squeegee in such a manner that the distal end surfaces of the female threaded rivets 48 and 48 is in abutment with and thereby supported by the squeegee. Here, depending on the usage, distal ends of the screws 26 and 26 possibly abut against the base portion 42*a* of the support base 42 and hinders attachment of the washer 34 to the squeegee. Therefore, two round holes 50 and 50 are formed at respective positions between the female threaded rivets 48 and 48 in the base portion 42*a*. These round holes 50 and 50 receive the respective distal ends of the screws 26 and 26 and thereby prevent the distal ends from abutting against the base portion 42*a* of the support base 42. Therefore, in any usage, no round holes 50 and 50 may be provided if the distal ends of the screws 26 and 26 do not abut against the base portion 42*a* of the support base 42.

Figure 7:
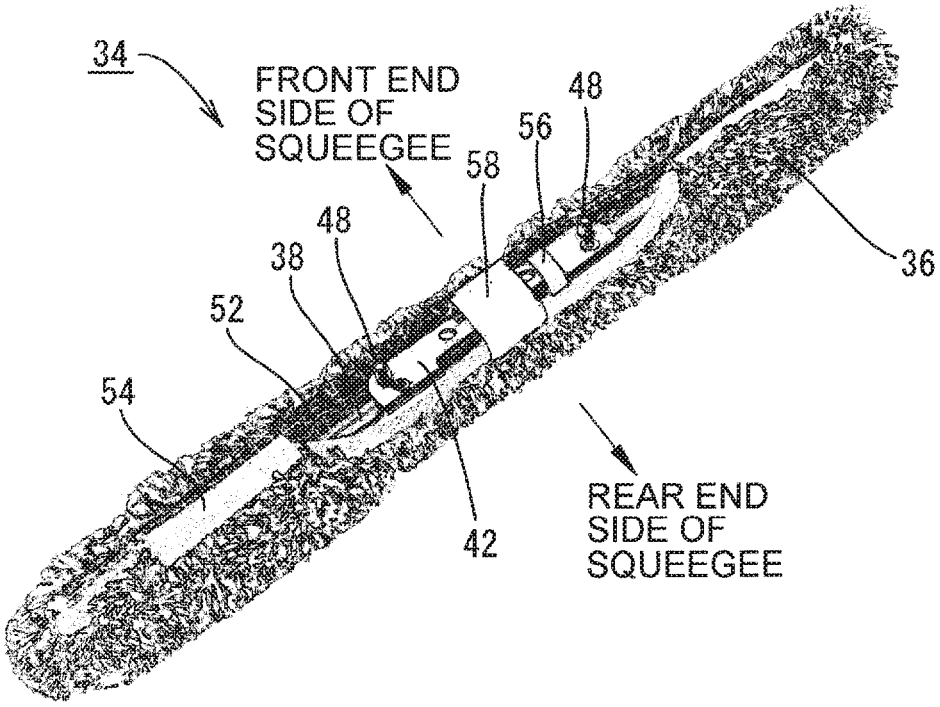
FIG. 7 is a perspective view illustrating a washer configured by covering the core member 38 in FIG. 5 by an impregnation body 36.

In FIG. 5, for the impregnation body 36, a raised fabric having a raised front surface is used and the impregnation body 36 is fabricated by sewing the fabric into a sac-like shape. At a side in a short direction of the impregnation body 36, an opening 52 for inserting/removing the core member 38 is formed. In the opening 52 of the impregnation body 36, a pair of hook-and-loop fasteners 54 for openably closing the opening 52 is sewn and attached along edges of the opening 52 that face each other. Two rubber strings 56 and 56 are sewn and attached to two positions in a longitudinal direction of an inner peripheral surface of the opening 52 of the impregnation body 36. These rubber strings 56 and 56 are intended to let right and left parts of the core member 38 through, respectively. In the impregnation body 36, at a center position in the longitudinal direction of the impregnation body 36, a pair of hook-and-loop fasteners 58 for openably closing a part at the center position of the opening 52 is sewn and attached to edges of the opening 52 that face each other. The core member 38 and the impregnation body 36 are assembled as follows. While the right and left parts of the core member 38 are let through via the respective rubber strings 56 and 56, the core member 38 is inserted to an inner space of the impregnation body 36 from the opening 52. Next, the hook-and-loop fasteners 54 and 58 are closed. Consequently, the washer 34 including the core member 38 covered by the impregnation body 36, which is illustrated in FIG. 7, is configured.

Figure 8A:
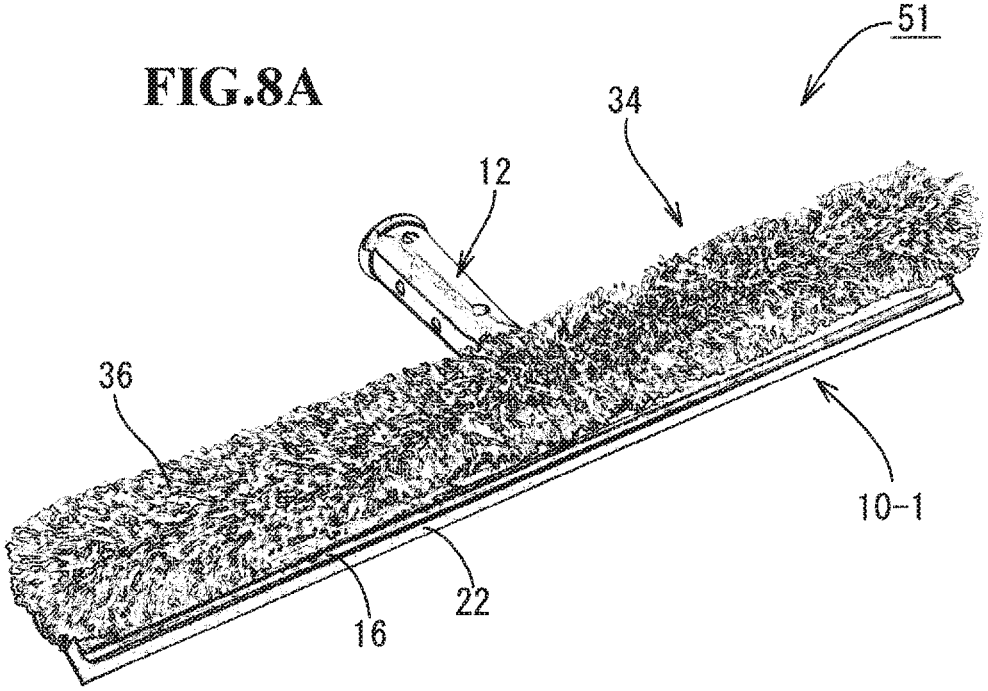
FIG. 8A is a perspective view of a combination squeegee (washer-equipped squeegee) obtained by attachment of the washer in FIG. 7 to the back side of the washer attachment component-equipped squeegee in FIGS. 1A and 1B, as viewed from the back side.
Figure 8B:
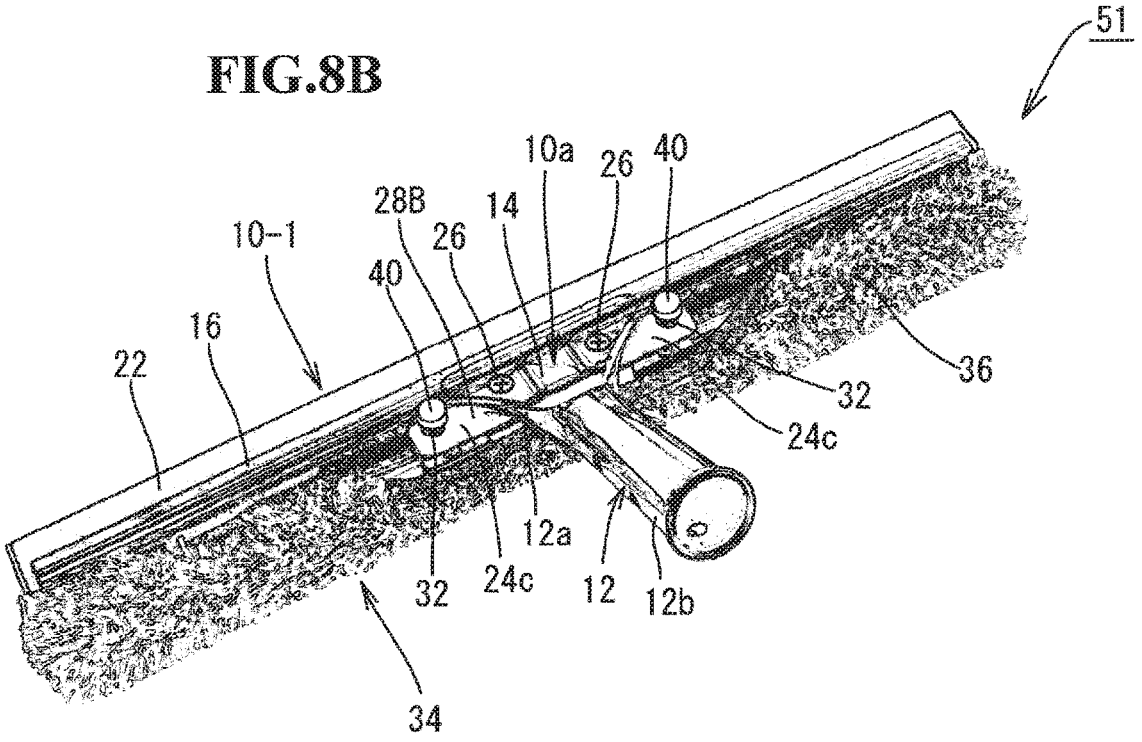
FIG. 8B is a perspective view of the combination squeegee in FIG. 8A as viewed from the front side.
Figure 9A:
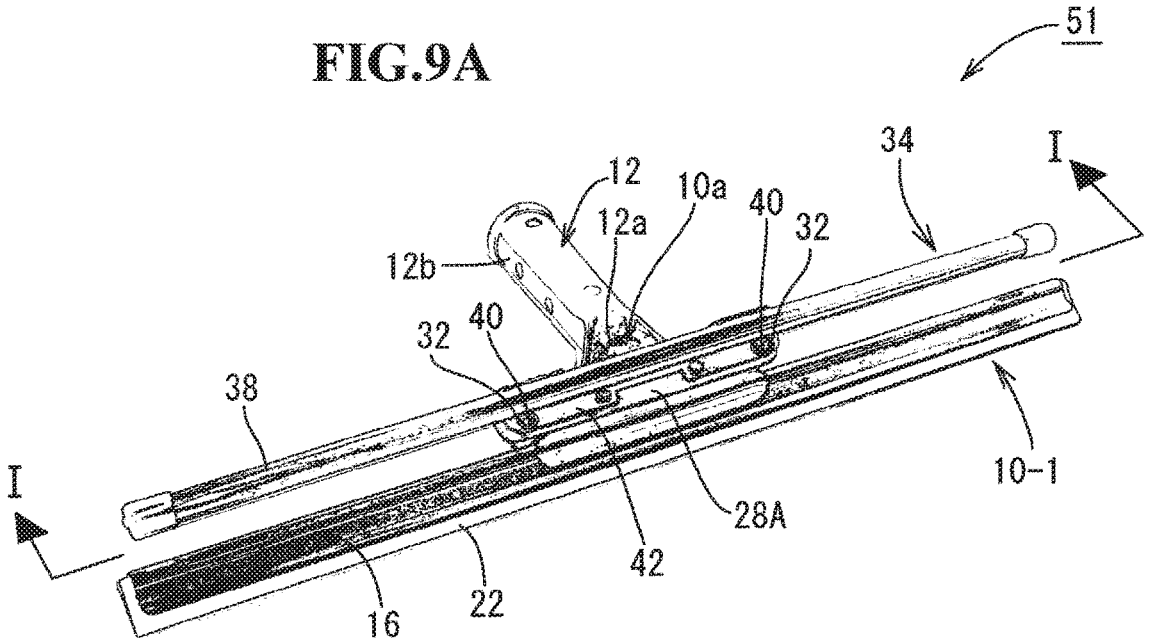
FIG. 9A is a perspective view of the combination squeegee in FIGS. 8A and 8B with the impregnation body removed, as viewed from the back side.
Figure 9B:
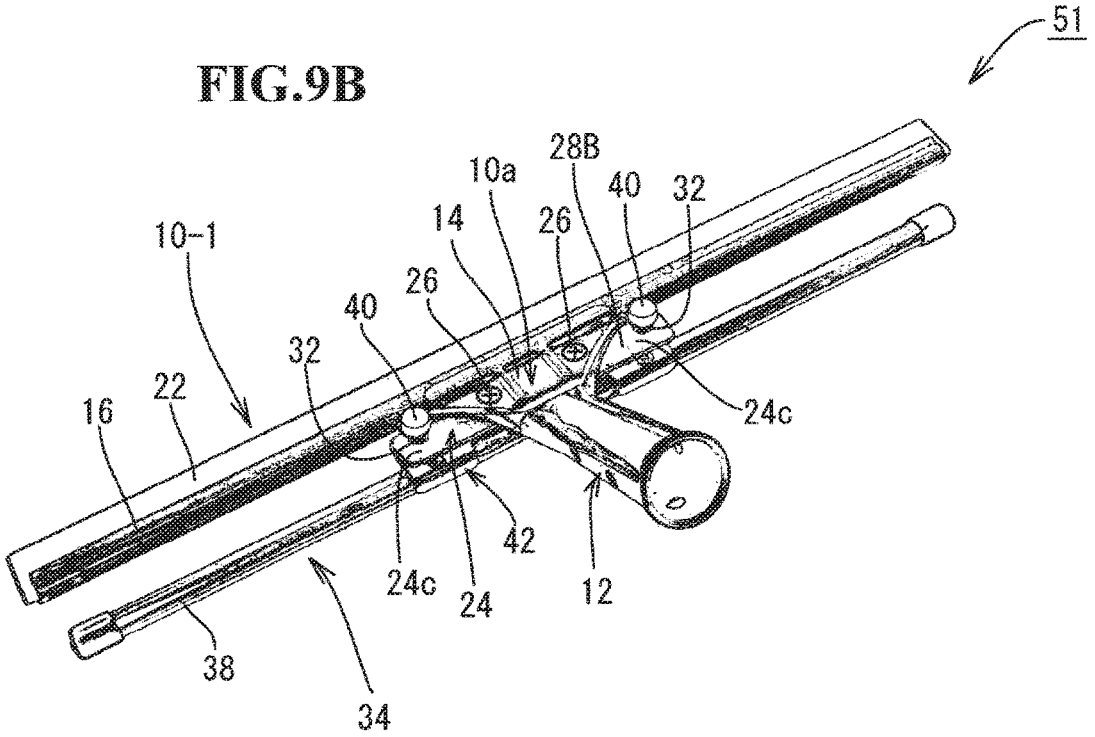
FIG. 9B is a perspective view of the combination squeegee in the state in FIG. 9A, as viewed from the front side.
Figure 28:
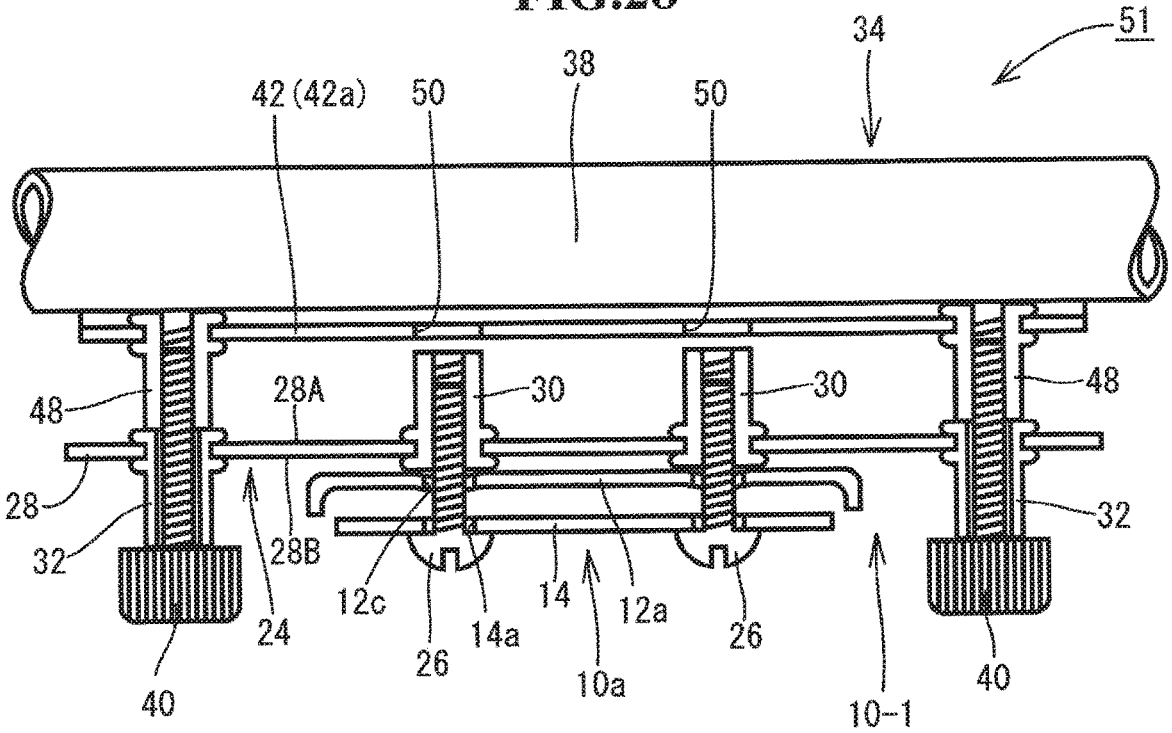
FIG. 28 is a cross-sectional view along arrow I-I in FIG. 9A.

A procedure for attaching the washer 34 in FIG. 7 to the back side of the washer attachment component-equipped squeegee 10-1 in FIGS. 1A and 1B is as follows. The washer 34 in FIG. 7 is disposed on the back side of the squeegee head 10*a* of the washer attachment component-equipped squeegee 10-1. Respective proximal ends of the non-female threaded rivets 32 and 32 of the washer attachment component 24, the proximal ends being exposed on the surface 28A side, and the respective distal ends of the female threaded rivets 48 and 48 of the washer 34 are coaxially disposed and brought into abutment with each other. Consequently, the hollows of the non-female threaded rivet 32 and 32 and the hollows of the female threaded rivets 48 and 48 communicate with each other. In this state, the hand screws 40 and 40 are inserted into the non-female threaded rivets 32 and 32 from the front side of the washer attachment component-equipped squeegee 10-1, and screwed into the female threaded rivets 48 and 48 and fastened. The fastening force of the hand screws 40 and 40 brings the proximal ends of the non-female threaded rivet 32 and 32 and the distal ends of the female threaded rivets 48 and 48 into firm abutment with each other, whereby the washer 34 is attached to the back side of the squeegee head 10*a* of the washer attachment component-equipped squeegee 10-1 with no backlash. FIG. 8A (state as viewed from the back side) and FIG. 8B (state as viewed from the front side) illustrate a combination squeegee (washer-equipped squeegee) 51 configured as described above. Also, FIG. 9A (state as viewed from the back side) and FIG. 9B (state as viewed from the front side) illustrate the combination squeegee 51 in such a manner that the impregnation body 36 is removed for easy understanding of the attachment. Also, FIG. 28 illustrates a cross-section of the combination squeegee 51 cut along arrow I-I in FIG. 9A. The combination squeegee 51 in FIGS. 8A and 8B can be used for washing via the washer 34 and water removal via the squeegee 10-1, which can be switched from one to the other by reversing the handle 12 axially. The hand screws 40 and 40 are loosened to cancel the joining between the washer attachment component-equipped squeegee 10-1 and the washer 34, enabling the washer attachment component-equipped squeegee 10-1 to be used alone as a simple squeegee.

Figure 10A:
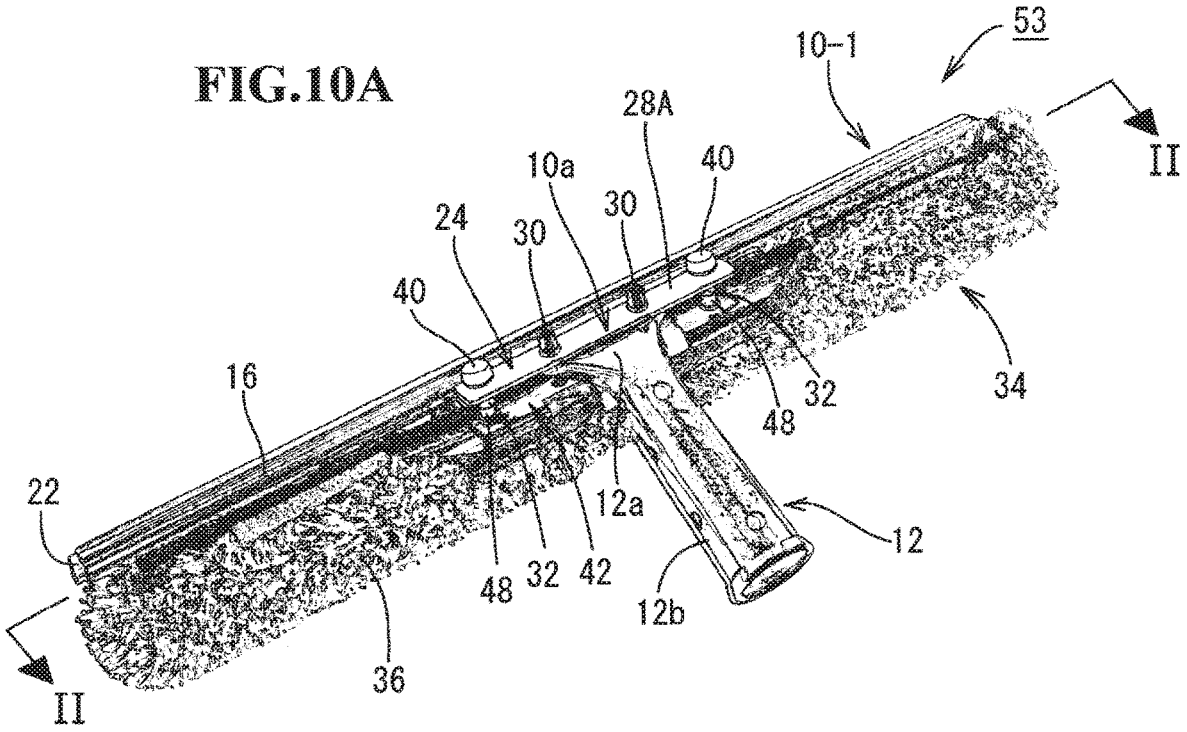
FIG. 10A is a perspective view of a combination squeegee obtained by attachment of the washer in FIG. 7 to the front side of the washer attachment component-equipped squeegee in FIGS. 1A and 1B, as viewed from the back side.
Figure 29:
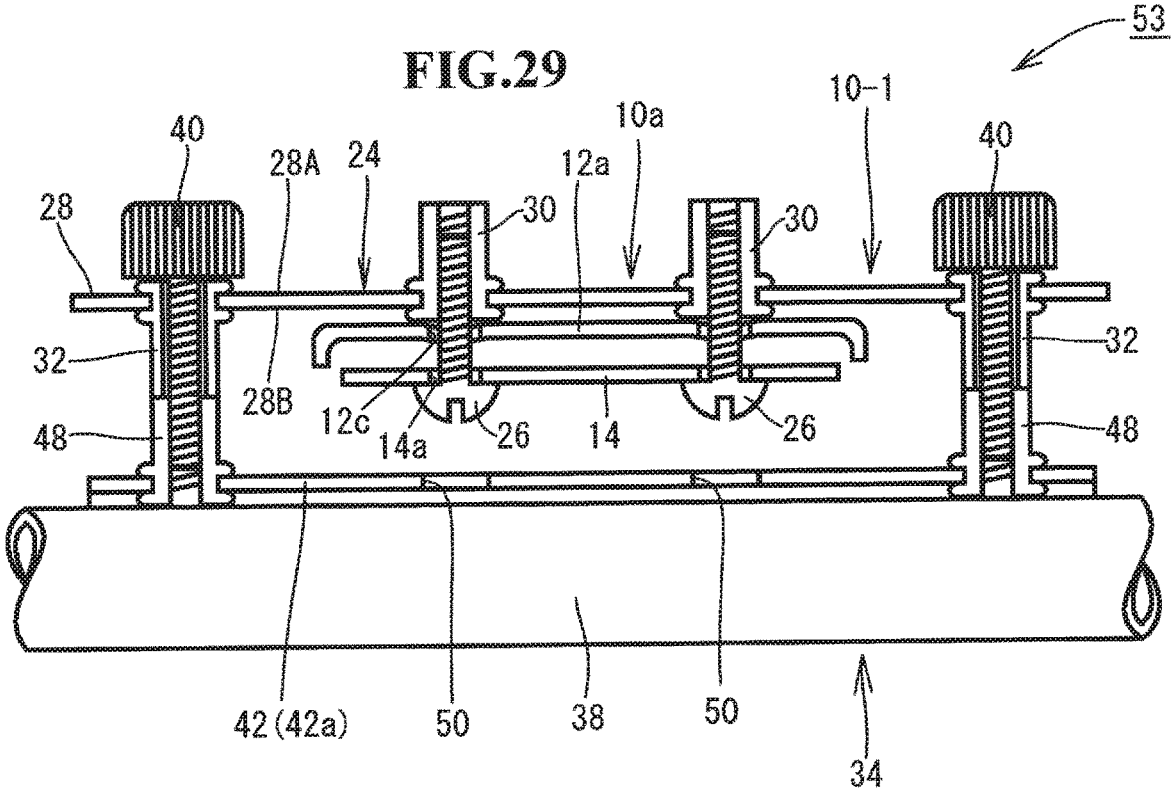
FIG. 29 is a cross-sectional view along arrow II-II in FIG. 10A (which is illustrated in such a manner that the impregnation body is removed)

A procedure for attaching the washer 34 in FIG. 7 to the front side of the washer attachment component-equipped squeegee 10-1 in FIGS. 1A and 1B is as follows. The washer 34 in FIG. 7 is disposed on the front side of the squeegee head 10*a* of the washer attachment component-equipped squeegee 10-1. Respective distal ends of the non-female threaded rivets 32 and 32 of the washer attachment component 24 and the respective distal ends of the female threaded rivets 48 and 48 of the washer 34 are coaxially disposed and brought into abutment with each other. Consequently, the hollows of the non-female threaded rivets 32 and 32 and the hollows of the female threaded rivets 48 and 48 communicate with each other. In this state, the hand screws 40 and 40 are inserted into the non-female threaded rivets 32 and 32 from the back side of the washer attachment component-equipped squeegee 10-1, and screwed into the female threaded rivets 48 and 48 and fastened. The fastening force of the hand screws 40 and 40 brings the distal ends of the non-female threaded rivets 32 and 32 and the distal ends of the female threaded rivets 48 and 48 into firm abutment with each other, whereby the washer 34 is attached to the front side of the squeegee head 10*a* of the washer attachment component-equipped squeegee 10-1 with no backlash. FIG. 10A (state as viewed from the back side), FIG. 10B (state as viewed from the front side) illustrate a combination squeegee 53 configured as described above. Also, FIG. 29 illustrates a cross-section of the combination squeegee 53 cut along arrow II-II in FIG. 10A (in such a manner that the impregnation body 36 is removed). This combination squeegee 53 enables washing via the washer 34 and water removal via the squeegee 10-1 to be performed at one time with no need to reverse the handle 12.

<<Alteration of Embodiment 1>>

Figure 11A:
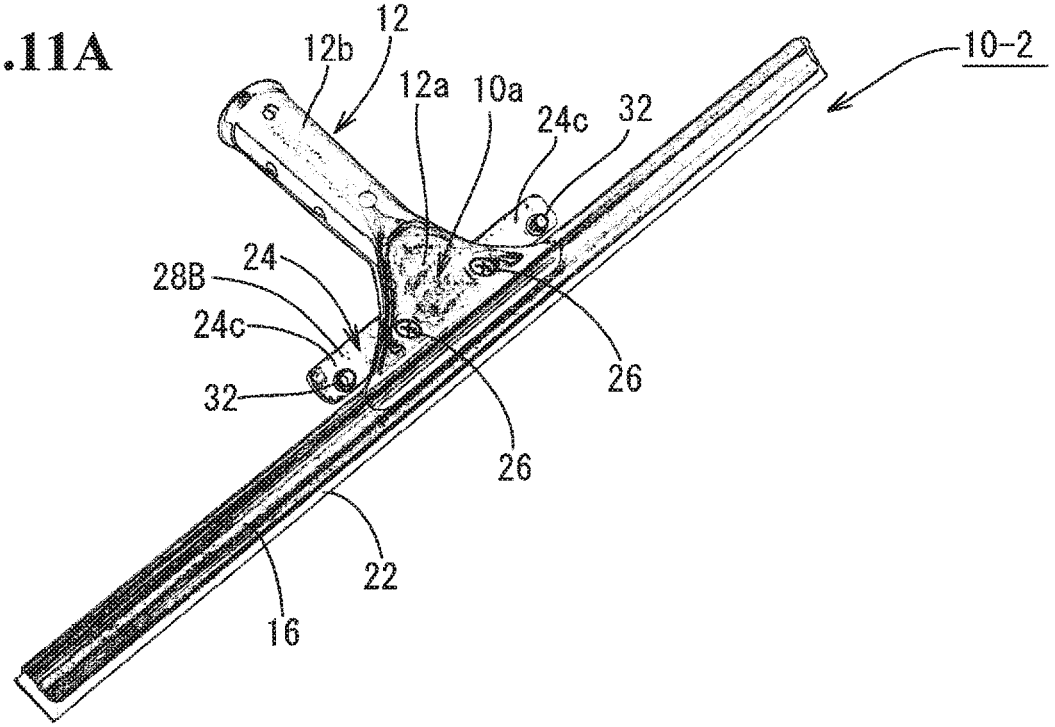
FIG. 11A is a diagram illustrating an alteration of Embodiment 1 of a squeegee according to this invention, which is a perspective view of a washer attachment component-equipped squeegee obtained by attachment of the washer attachment component in FIG. 4 to the front side of the squeegee in FIG. 2, as viewed from the back side.
Figure 11B:
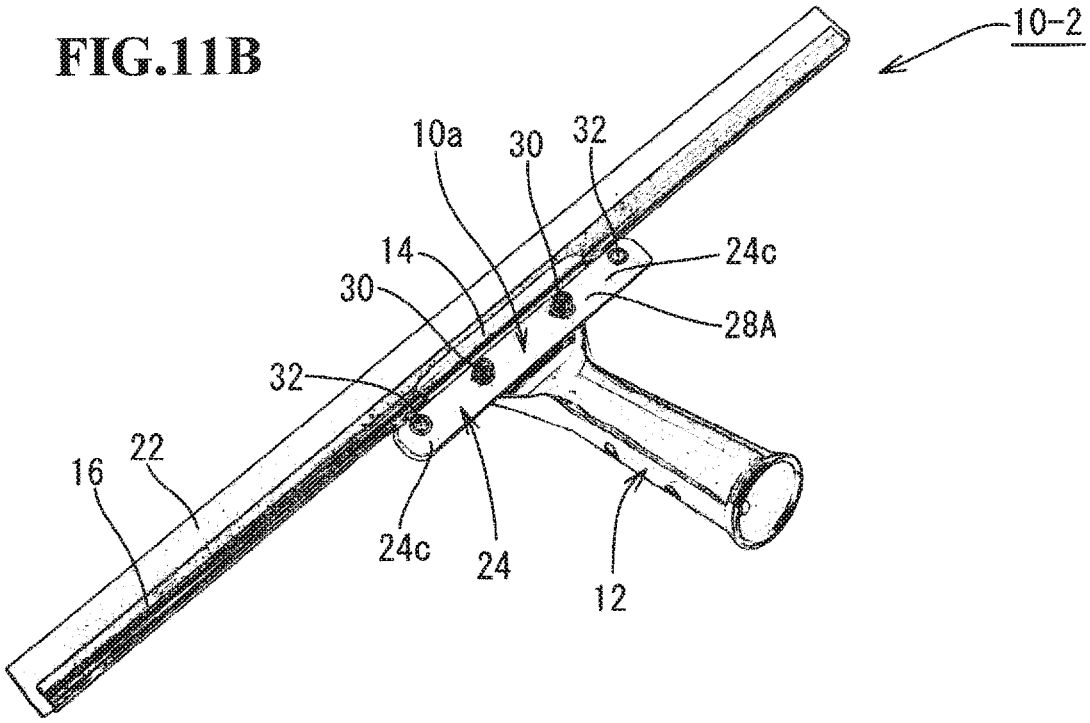
FIG. 11B is a perspective view of the washer attachment component-equipped squeegee in FIG. 11A as viewed from the front side.

Although in Embodiment 1, the washer attachment component 24 is attached to the back side of the squeegee 10, the washer attachment component 24 can also be attached to the front side of the squeegee 10. FIG. 11A (state as viewed from the back side) and FIG. 11B (state as viewed from the front side) illustrate a washer attachment component 24 attached to the front side of a squeegee 10. Components used for forming the washer attachment component-equipped squeegee 10-2 are the same as those used in Embodiment 1. A procedure for assembling the washer attachment component-equipped squeegee 10-2 in FIGS. 11A and 11B is as follows. A back plate 14 is received in a depression 12*e* on the front side of the handle head 12*a*. A channel 16 is put into a front end between a handle head 12*a* and the back plate 14. So far, the procedure is the same as the procedure for assembling the conventional squeegee 10 in FIG. 2. Next, a surface 28B of the washer attachment component 24 is brought into abutment with the front side of a squeegee head 10*a*, and the washer attachment component 24 is mounted on the front side of the squeegee head 10*a*. Two screws 26 are sequentially inserted into respective screw passing holes 12*c* and 14*a* from the back side of the squeegee head 10*a*, and screwed into female threaded rivets 30 of the washer attachment component 24 and fastened. Consequently, the handle 12, the back plate 14 and the washer attachment component 24 are joined to one another, and the channel 16 is clamped by the front end between the handle head 12*a* and the back plate 14. As described above, the washer attachment component 24, the handle 12, the back plate 14 and the channel 16 are assembled and integrated as in FIGS. 11A and 11B in such a manner that disassembling is possible. Consequently, the washer attachment component-equipped squeegee 10-2 including the washer attachment component 24 attached to the squeegee head 10*a* is configured. Here, parts on opposite sides in a longitudinal direction of the washer attachment component 24 extend on the opposite, right and left, side from an area of the squeegee head 10*a* in which the handle head 12*a* and the back plate 14 are present and thus form right and left extensions 24*c* and 24*c*. The extensions 24*c* and 24*c* each form a part of the squeegee head 10*a*. The right and left extensions 24*c* and 24*c* are disposed outside the area of the squeegee head 10*a* in which the handle head 12*a* and the back plate 14 overlap each other. In the extensions 24*c* and 24*c*, respective non-female threaded rivets 32 and 32, which each form a washer attachment portion, are disposed so as to project on the back side of the washer attachment component-equipped squeegee 10-2. Also, the washer attachment component-equipped squeegee 10-2 can be used alone as a simple squeegee without attaching the washer 34 thereto, for removing water from a glass window. Here, the washer attachment component 24 is not an obstacle to the water removal work.

Figure 12A:
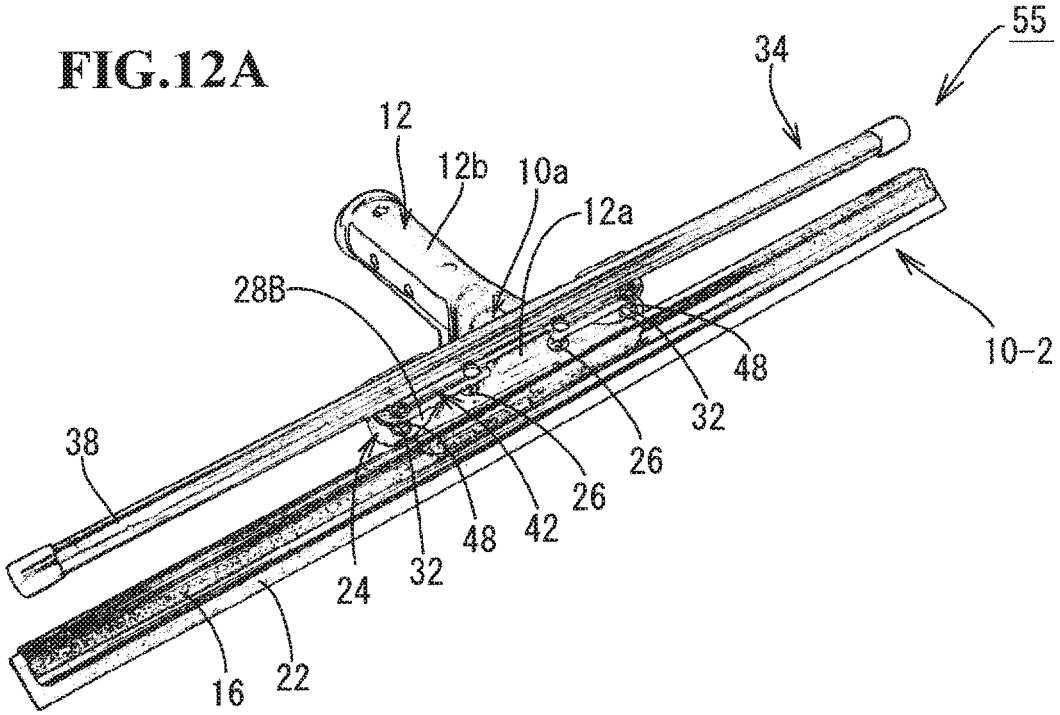
FIG. 12A is a perspective view of a combination squeegee obtained by attachment of the washer in FIG. 7 to the back side of the washer attachment component-equipped squeegee in FIGS. 11A and 11B, as viewed from the back side (which is illustrated in such a manner that the impregnation body is removed)
Figure 12B:
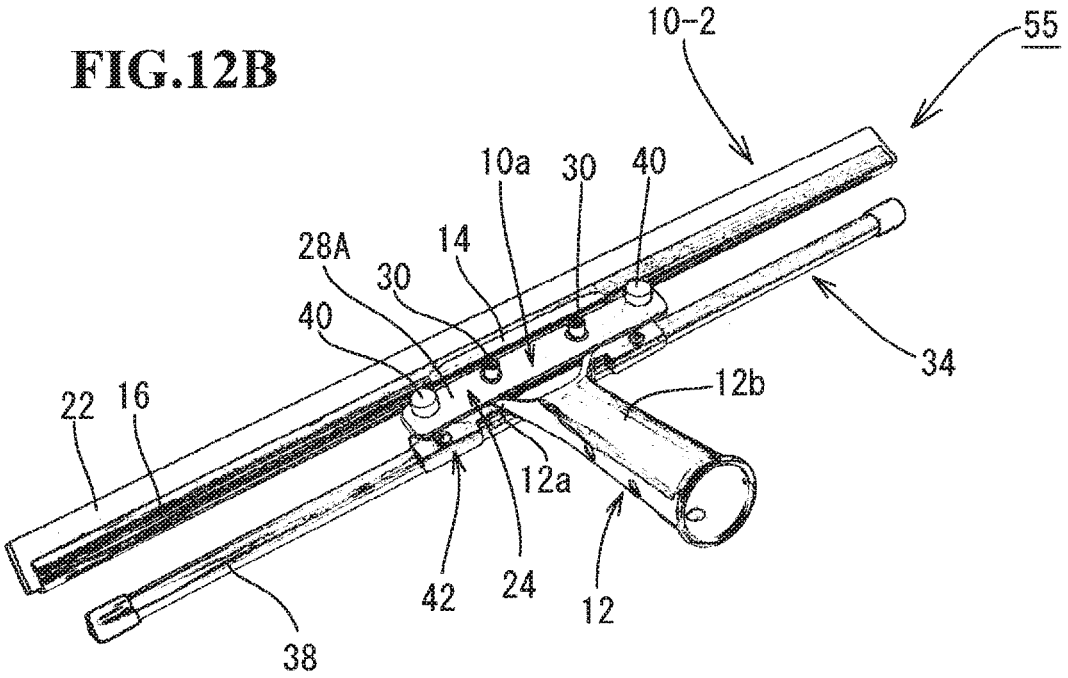
FIG. 12B is a perspective view of the combination squeegee in the state in FIG. 12A, as viewed from the front side.
Figure 13A:
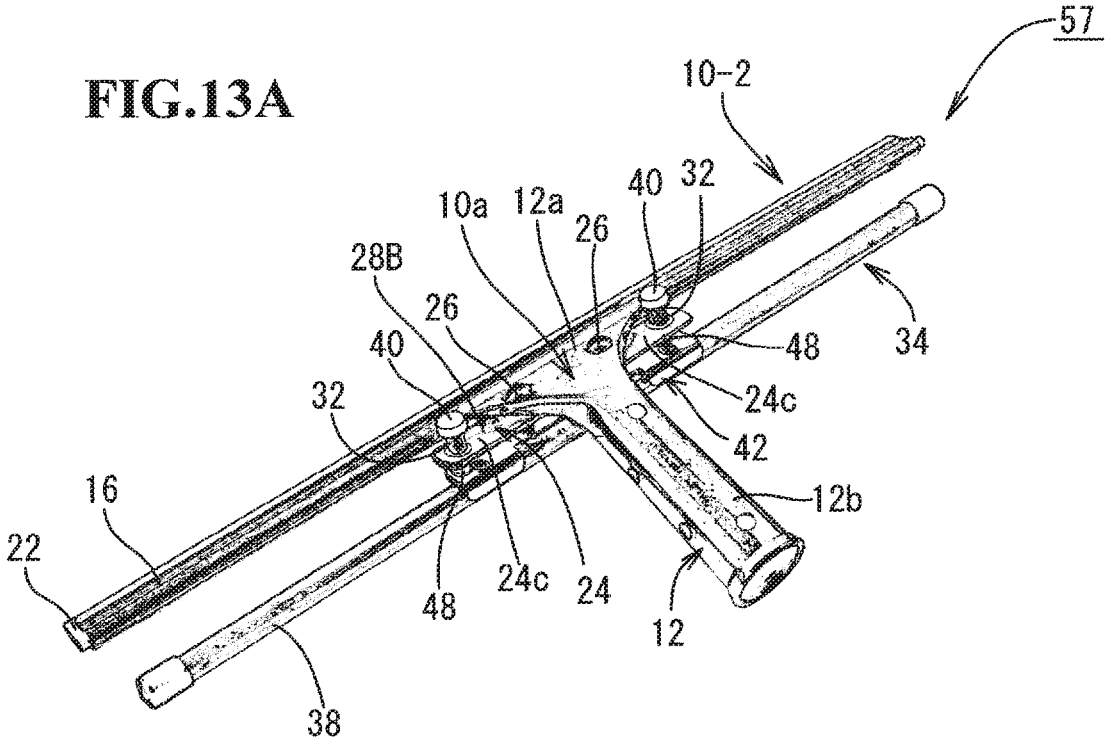
FIG. 13A is a perspective view of a combination squeegee obtained by attachment of the washer in FIG. 7 to the front side of the washer attachment component-equipped squeegee in FIGS. 11A and 11B as viewed from the back side, (which is illustrated in such a manner that the impregnation body is removed)
Figure 13B:
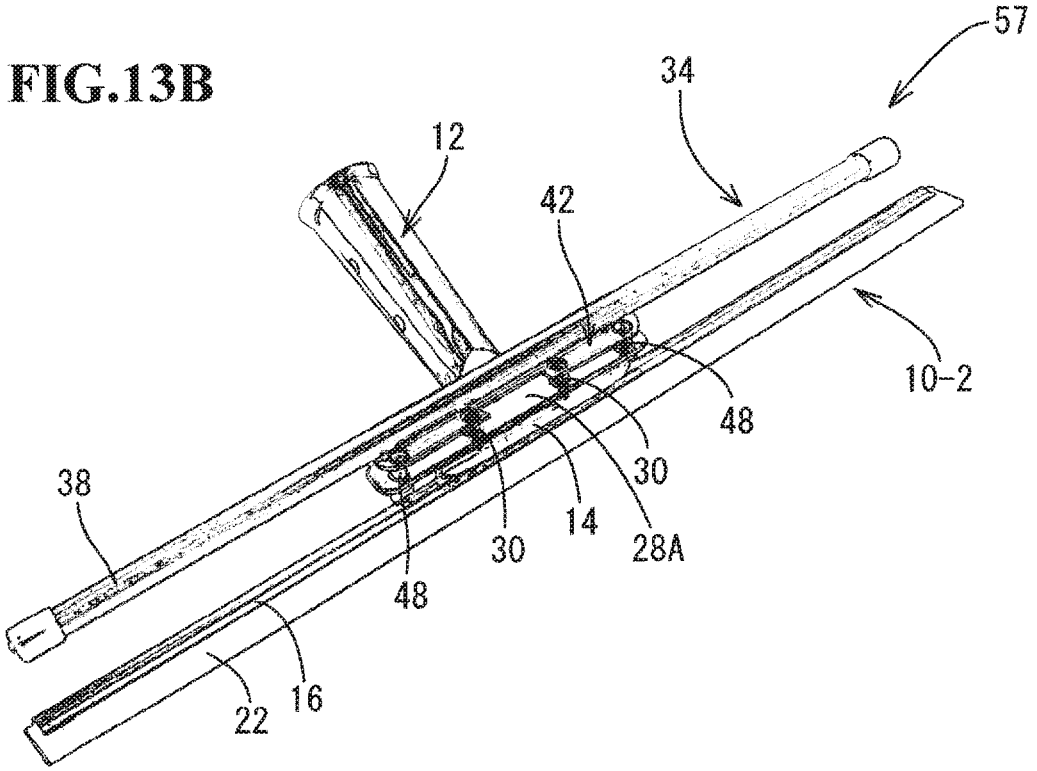
FIG. 13B is a perspective view of the combination squeegee in the state in FIG. 13A, as viewed from the front side.

The above-described washer 34 in FIG. 7 is removably attachable to either of the back side and the front side of the squeegee head 10*a* of the washer attachment component-equipped squeegee 10-2 in FIGS. 11A and 11B. A procedure for attaching the washer 34 to the back side of the washer attachment component-equipped squeegee 10-2 is as follows. The washer 34 in FIG. 7 is disposed on the back side of the squeegee head 10*a* of the washer attachment component-equipped squeegee 10-2. Respective distal ends of the non-female threaded rivets 32 and 32 of the washer attachment component 24 and the respective distal ends of the female threaded rivets 48 and 48 of the washer 34 are coaxially disposed and brought into abutment with each other. Consequently, hollows of the non-female threaded rivets 32 and 32 and the hollows of the female threaded rivets 48 and 48 communicate with each other. In this state, hand screws 40 and 40 are inserted into the non-female threaded rivets 32 and 32 from the front side of the washer attachment component-equipped squeegee 10-2 and screwed and fastened to the female threaded rivets 48 and 48. The fastening force of the hand screws 40 and 40 brings the distal ends of the non-female threaded rivets 32 and 32 and the distal ends of the female threaded rivet 48, 48 into firm abutment with each other, whereby the washer 34 is attached to the back side of the squeegee head 10*a* of the washer attachment component-equipped squeegee 10-2 with no backlash. FIG. 12A (state as viewed from the back side) and FIG. 12B (state as viewed from the front side) illustrate a combination squeegee 55 configured as above (in such a manner that an impregnation body is removed). Also, a procedure for attaching the washer 34 to the front side of the washer attachment component-equipped squeegee 10-2 is as follows. The washer 34 is disposed on the front side of the squeegee head 10*a* of the washer attachment component-equipped squeegee 10-2. Respective proximal ends of the non-female threaded rivets 32 and 32 of the washer attachment component 24, the proximal ends being exposed on the surface 28A side, and the respective distal ends of the female threaded rivets 48 and 48 of the washer 34 are coaxially disposed and brought into abutment with each other. Consequently, the hollows of the non-female threaded rivets 32 and 32 and the hollows of the female threaded rivets 48 and 48 communicate with each other. In this state, the hand screws 40 and 40 are inserted into the non-female threaded rivets 32 and 32 from the back side of the washer attachment component-equipped squeegee 10-2 and screwed and fastened to the female threaded rivets 48 and 48. The fastening force of the hand screws 40 and 40 brings the proximal ends of the non-female threaded rivets 32 and 32 and the distal ends of the female threaded rivets 48 and 48 into firm abutment with each other, whereby the washer 34 is attached to the front side of the squeegee head 10*a* of the washer attachment component-equipped squeegee 10-2 with no backlash. FIG. 13A (state as viewed from the back side) and FIG. 13B (state as viewed from the front side) illustrate a combination squeegee 57 configured as above (in such a manner that the impregnation body is removed).

Embodiment 2

Figure 14:
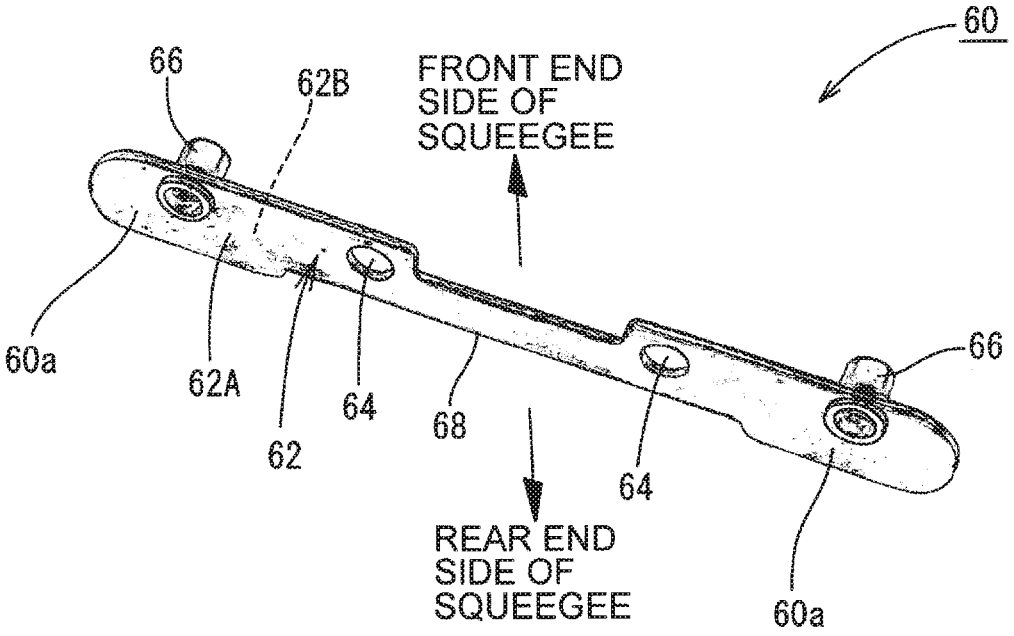
FIG. 14 is a diagram illustrating Embodiment 2 of a washer attachment component according to this invention, which is a perspective view illustrating a washer attachment component to be attached to the squeegee in FIG. 2 for use.

Embodiment 2 of this invention will be described. This embodiment provides another squeegee according to this invention obtained by attachment of another washer attachment component according to this invention to a conventional squeegee so that a washer is removably attachable to the squeegee. For parts that are in common with those of Embodiment 1, reference numerals that are the same as those used in Embodiment 1 are used. FIG. 14 illustrates a washer attachment component 60 to be attached to the conventional squeegee 10 in FIG. 2 for use. The washer attachment component 60 is clamped between the handle head 12*a* and the back plate 14 and thereby attached to the squeegee 10. For the attachment of the washer attachment component 60 to the squeegee 10, the two screws 18 and the two nuts 20 in FIG. 2 can be used as they are. The washer attachment component 60 is formed by providing two screw passing holes 64 and 64 in a plate 62, which forms a washer attachment component body, and attaching two non-female threaded rivets 66 and 66 that are hollow (that is, include a through hole) at other positions. The plate 62 is formed of, for example, a metal plate (flat plate) of, e.g., aluminum having a length of around 11 cm, a width of around 2 cm and a thickness of around 2 mm. The screw passing holes 64 and 64 are disposed with a center position in a longitudinal direction of the plate 62 therebetween, at respective positions equally distant from the center position. These screw passing holes 64 and 64 each form a squeegee attachment portion, and allow shafts of the two screws 18 in FIG. 2 to be inserted therethrough. Therefore, a distance between axes of the screw passing holes 64 and 64 is equal to the distance between the axes of the two screw passing holes 12*c* and 12*c* of the handle head 12*a* and also to the distance between the axes of the two screw passing holes 14*a* and 14*a* of the back plate 14. The non-female threaded rivets 66 and 66 each form a washer attachment portion, and are disposed with the center position in the longitudinal direction of the plate 62 therebetween, at respective positions equally distant from the center position (positions at which a distance from the center position in the longitudinal direction of the plate 62 is longer than that of the screw passing holes 64 and 64, the positions being close to respective opposite ends in the longitudinal direction of the plate 62). An outer diameter of the non-female threaded rivets 66 and 66 is equal to an outer diameter of the female threaded rivets 48 (FIG. 6) of the washer 34. At a position of the washer attachment component 60 attached to the squeegee 10, the non-female threaded rivets 66 and 66 are disposed on opposite, right and left, side of the handle head 12*a* across the handle head 12*a*. A distance between axes of the two non-female threaded rivets 66 and 66 is set so as to have such a distance. The distance between the axes of the two non-female threaded rivets 66 and 66 is equal to the distance between the axes of the two female threaded rivets 48 and 48. Here, of opposite surfaces 62A and 62B in the plate thickness direction of plate 62, a surface on the side on which the non-female threaded rivets 66 project is referred to as "surface 62B", and a surface on the side opposite to that side is referred to as "surface 62A". The washer attachment component 60 according to this embodiment is designed to be attached to the squeegee 10 in such a manner that the surface 62A faces the front side of the squeegee 10 and the surface 62B faces the back side of the squeegee 10. In a center of a side of the plate 62 to be positioned on the rear end side of the squeegee 10, a cutout 68 is formed so as not to hinder disposition of the back plate 14.

Figure 15A:
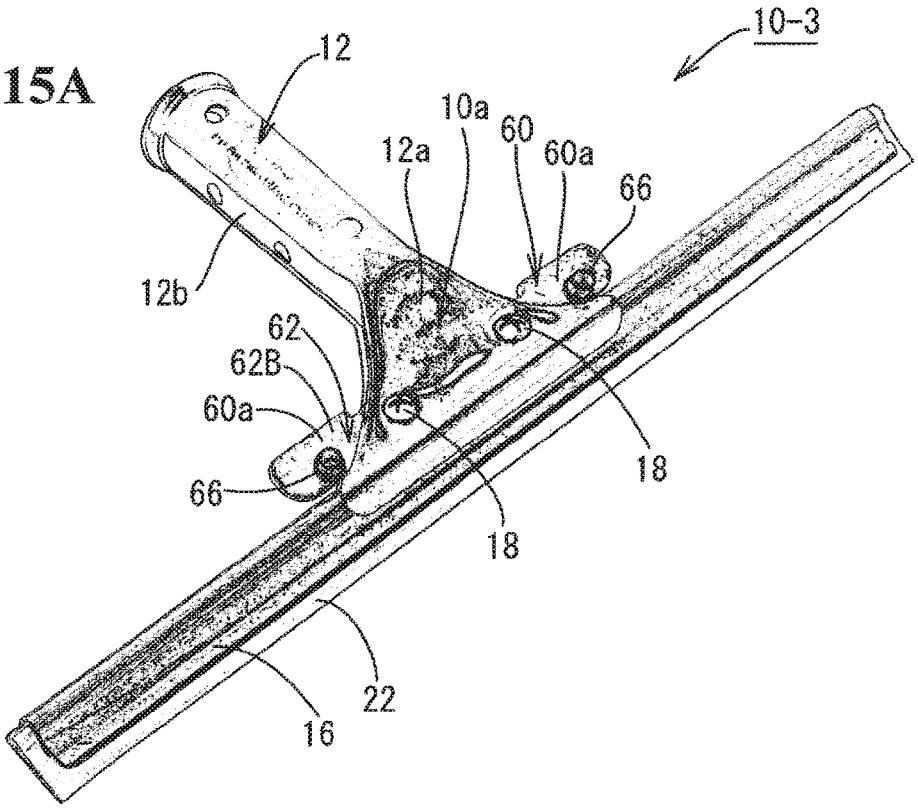
FIG. 15A is a diagram illustrating Embodiment 2 of the squeegee according to this invention, which is a perspective view of a washer attachment component-equipped squeegee obtained by clamping the washer attachment component in FIG. 14 between a handle head and a back plate of the squeegee in FIG. 2 (however, a length of a channel of the squeegee is shorter than that in FIG. 2) and thereby attaching the washer attachment component to the squeegee, as viewed from the back side.
Figure 15B:
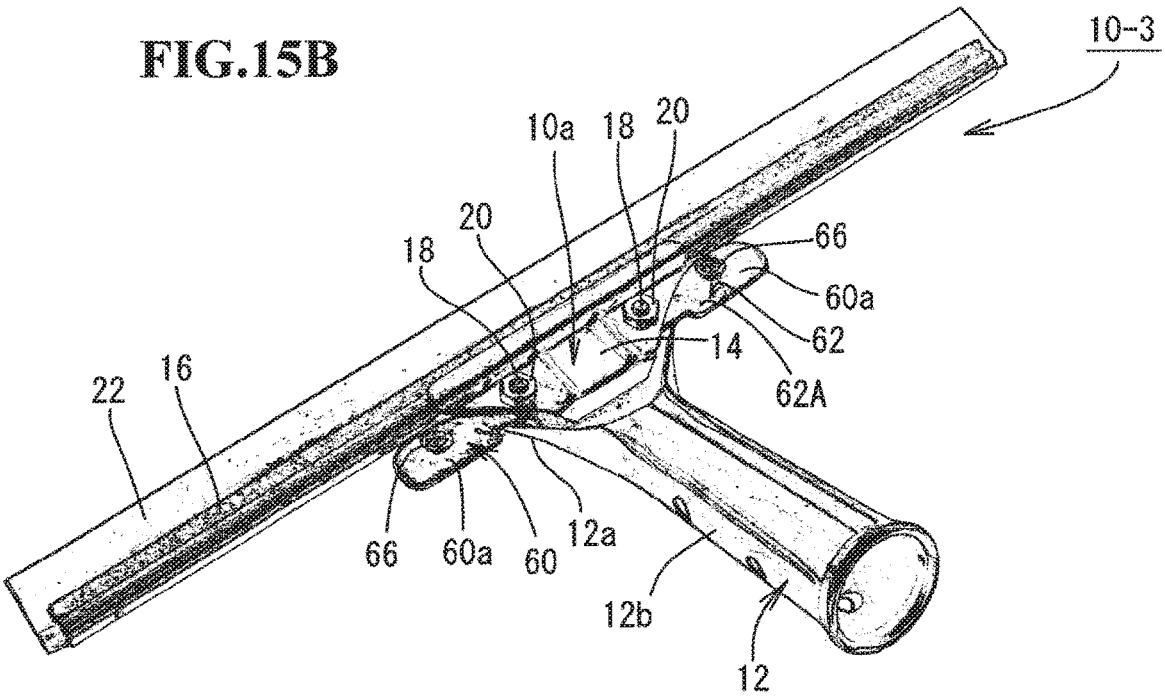
FIG. 15B is a perspective view of the washer attachment component-equipped squeegee in FIG. 15A as viewed from the front side.

FIG. 15A (state as viewed from the back side) and FIG. 15B (state as viewed from the front side) illustrate the washer attachment component 60 in FIG. 14 attached to the squeegee 10 in FIG. 2. A procedure for assembling a washer attachment component-equipped squeegee 10-3 in FIGS. 15A and 15B is as follows. The washer attachment component 60 is put into between the handle head 12*a* and the back plate 14, and the back plate 14 is received in the depression 12*e* on the front side of the handle head 12*a*. The channel 16 is put into the front end between the handle head 12*a* and the back plate 14. Next, the screws 18 and 18 are inserted into the screw passing holes 12*c* of the handle head 12*a*, the screw passing holes 64 of the washer attachment component 60 and the screw passing holes 14*a* of the back plate 14 sequentially from the back side of the handle head 12*a*, and screwed and fastened to the nuts 20 and 20 on the front side of the back plate 14. Consequently, the handle 12, the washer attachment component 60 and the back plate 14 are joined to one another, and the channel 16 is clamped by the front end between the handle head 12*a* and the back plate 14. As described above, the washer attachment component 60, the handle 12, the back plate 14 and the channel 16 are assembled and integrated as in FIGS. 15A and 15B in such a manner that disassembling is possible. Consequently, the washer attachment component-equipped squeegee 10-3 including the washer attachment component 60 attached to the squeegee head 10*a* is configured. Here, parts on the opposite sides in a longitudinal direction of the washer attachment component 60 extend on the opposite, right and left, sides from an area of the squeegee head 10*a* in which the handle head 12*a* and the back plate 14 are present and thus form right and left extensions 60*a* and 60*a*. The extensions 60*a* and 60*a* each form a part of the squeegee head 10*a*. The right and left extensions 60*a* and 60*a* are disposed outside the area of the squeegee head 10*a* in which the handle head 12*a* and the back plate 14 overlap each other. In the extensions 60*a* and 60*a*, the respective non-female threaded rivets 66 and 66, which each form a washer attachment portion, are disposed so as to project on the back side of the washer attachment component-equipped squeegee 10-3. Also, the washer attachment component-equipped squeegee 10-3 can be used alone as a simple squeegee without attaching the washer 34 thereto, for removing water from a glass window. In this case, the washer attachment component 60 is not an obstacle to the water removal work.

Figure 16A:
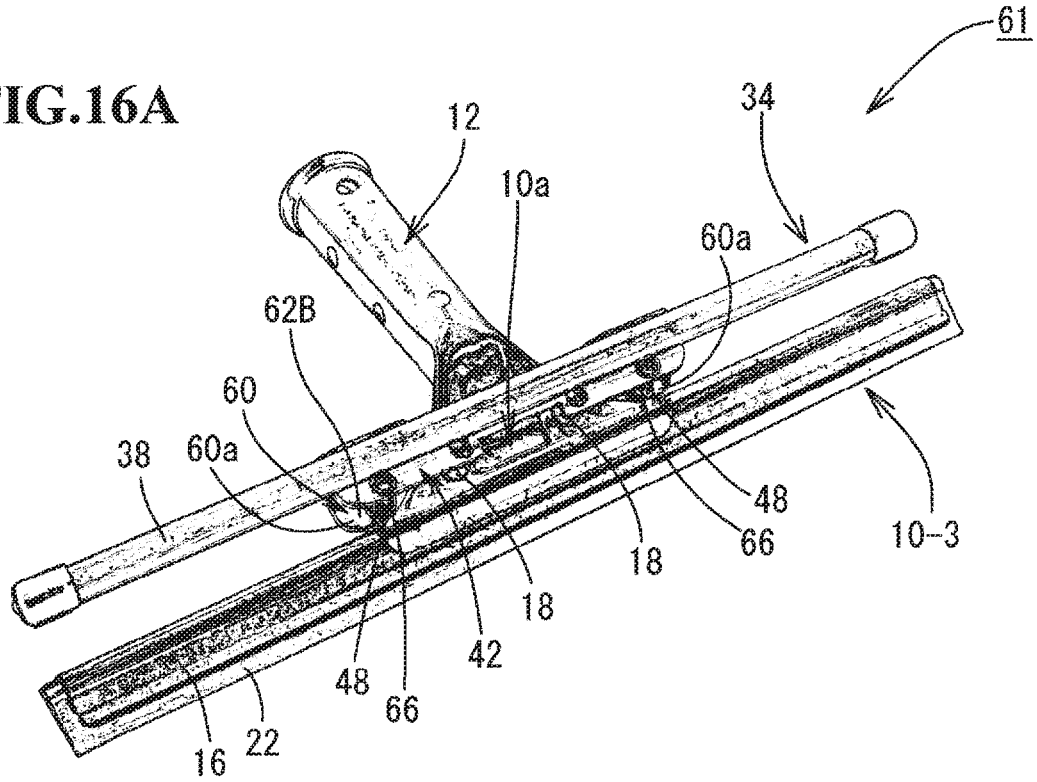
FIG. 16A is a perspective view of a combination squeegee obtained by attachment of the washer in FIG. 7 (however, a length of the washer is shorter than that in FIG. 7) to the back side of the washer attachment component-equipped squeegee in FIGS. 15A and 15B, as viewed from the back side (which is illustrated in such a manner that the impregnation body is removed)
Figure 16B:
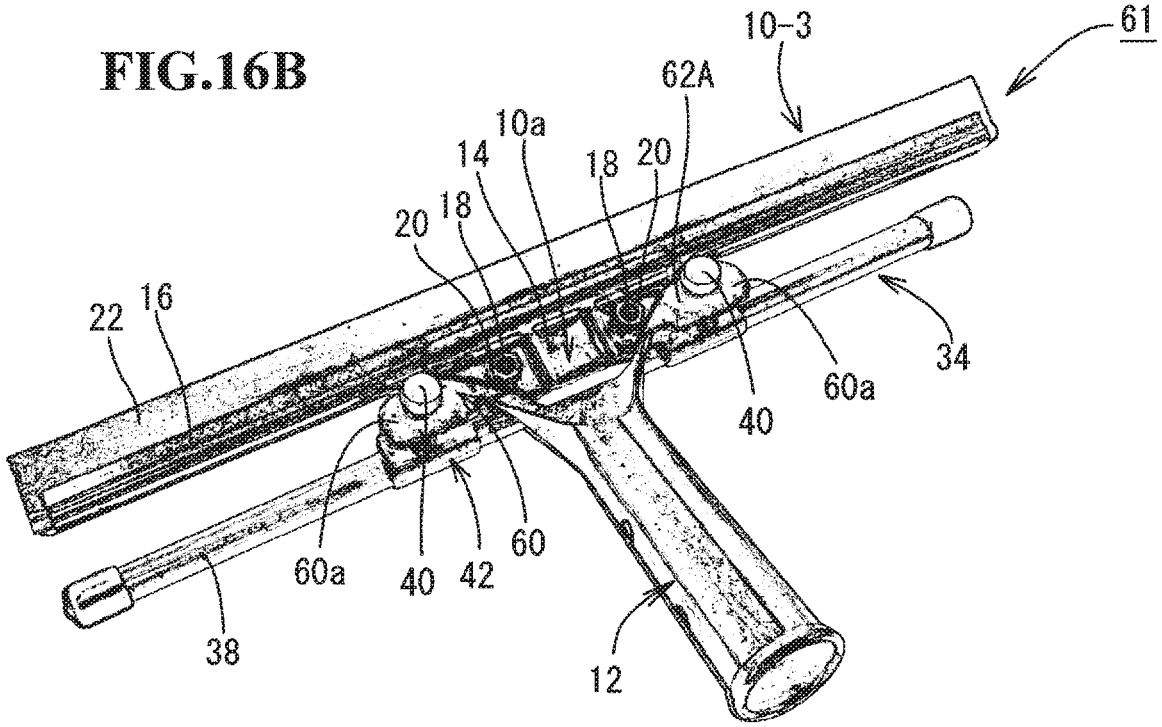
FIG. 16B is a perspective view of the combination squeegee in the state in FIG. 16A as viewed from the front side.
Figure 17A:
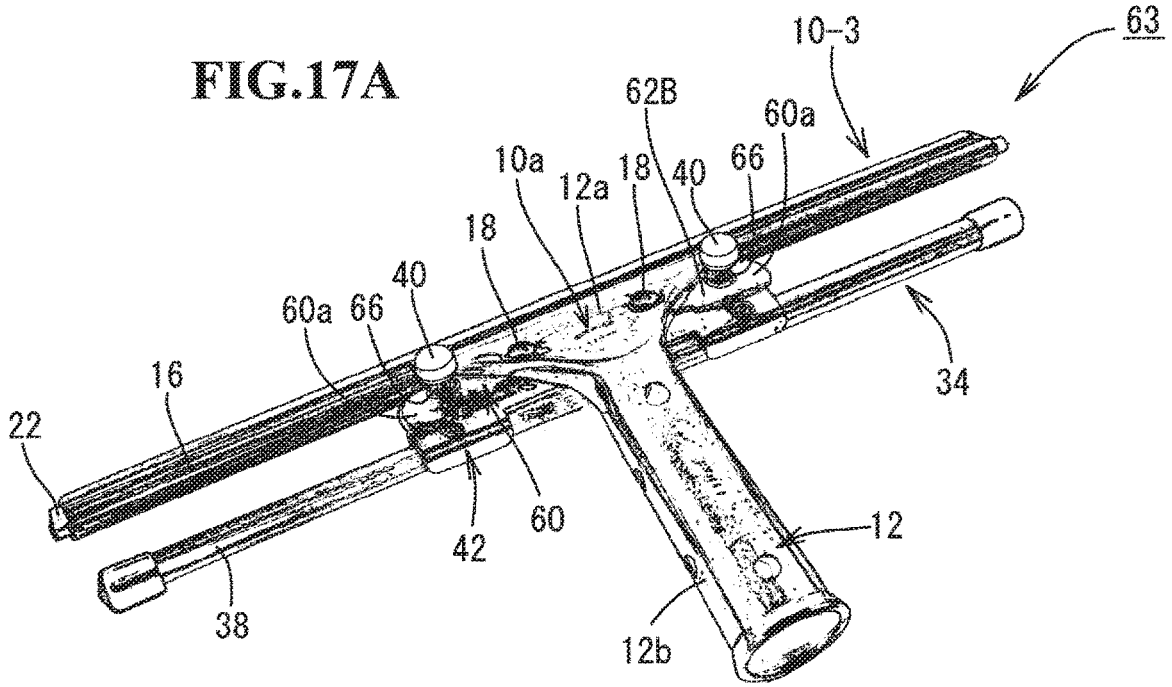
FIG. 17A is a perspective view of a combination squeegee obtained by attachment of the washer in FIG. 7 (however, a length of the washer is shorter than that in FIG. 7) to the front side of the washer attachment component-equipped squeegee in FIGS. 15A and 15B, as viewed from the back side (which is illustrated in such a manner that the impregnation body is removed)
Figure 17B:
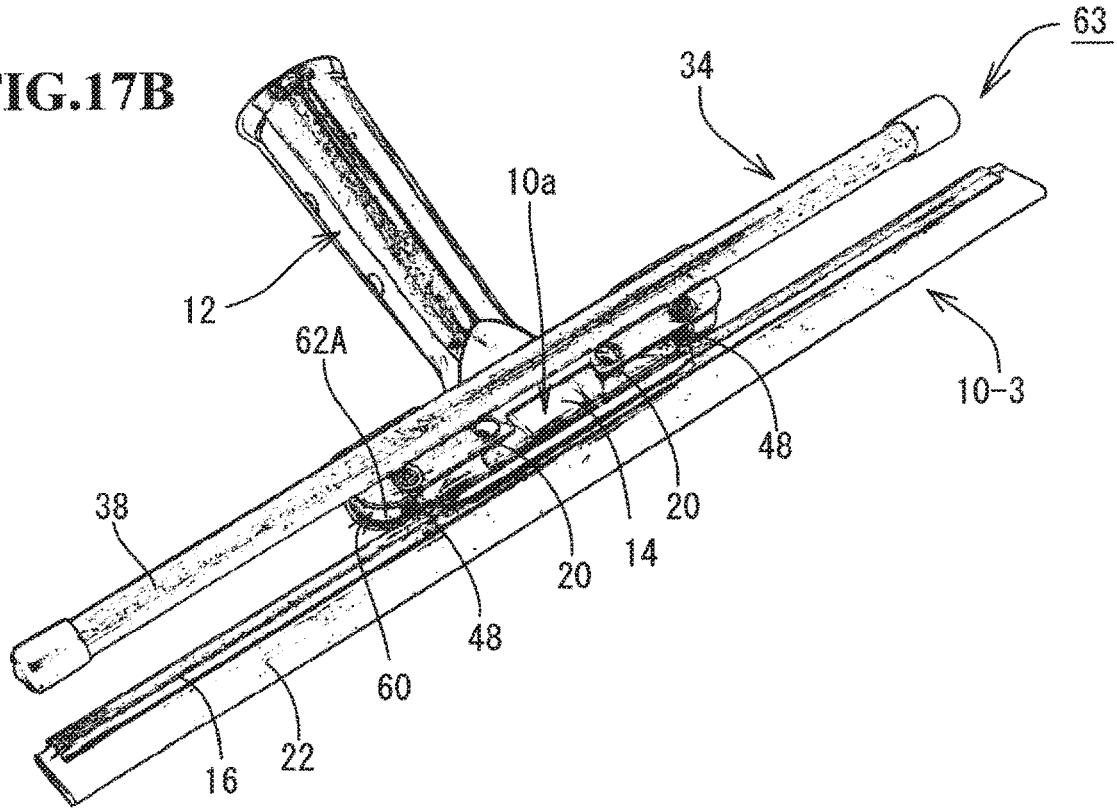
FIG. 17B is a perspective view of the combination squeegee in the state in FIG. 17A as viewed from the front side.

The above-described washer 34 in FIG. 7 is removably attachable to either of the back side and the front side of the squeegee head 10*a* of the washer attachment component-equipped squeegee 10-3 in FIGS. 15A and 15B. A procedure for attaching the washer 34 to the back side of the washer attachment component-equipped squeegee 10-3 is as follows. The washer 34 is disposed on the back side of the squeegee head 10*a* of the washer attachment component-equipped squeegee 10-3. Respective distal ends of the non-female threaded rivets 66 and 66 of the washer attachment component 60 and the respective distal ends of the female threaded rivets 48 and 48 of the washer 34 are coaxially disposed and brought into abutment with each other. Consequently, the hollows of the non-female threaded rivets 66 and 66 and the hollows of the female threaded rivets 48 and 48 communicate with each other. In this state, the hand screws 40 and 40 are inserted into the non-female threaded rivets 66 and 66 from the front side of the washer attachment component-equipped squeegee 10-3, and screwed into the female threaded rivets 48 and 48 and fastened. The fastening force of the hand screws 40 and 40 brings the distal ends of the non-female threaded rivets 66 and 66 and the distal ends of the female threaded rivets 48 and 48 into firm abutment with each other, whereby the washer 34 is attached to the back side of the squeegee head 10*a* of the washer attachment component-equipped squeegee 10-3 with no backlash. FIG. 16A (state as viewed from the back side) and FIG. 16B (state as viewed from the front side) illustrate a combination squeegee 61 configured as above (in such a manner that an impregnation body is removed). Also, a procedure for attaching the washer 34 to the front side of the washer attachment component-equipped squeegee 10-3 is as follows. The washer 34 is disposed on the front side of the squeegee head 10*a* of the washer attachment component-equipped squeegee 10-3. Respective proximal ends of the non-female threaded rivets 66 and 66 of the washer attachment component 60, the proximal ends being exposed on the surface 62A side, and the respective distal ends of the female threaded rivets 48 and 48 of the washer 34 are coaxially disposed and brought into abutment with each other. Consequently, the hollows of the non-female threaded rivets 66 and 66 and the hollows of the female threaded rivets 48 and 48 communicate with each other. In this state, the hand screws 40 and 40 are inserted into the non-female threaded rivets 66 and 66 from the back side of the washer attachment component-equipped squeegee 10-3, and screwed into the female threaded rivets 48 and 48 and fastened. The fastening force of the hand screws 40 and 40 bring the proximal ends of the non-female threaded rivets 66 and 66 and the distal ends of the female threaded rivets 48 and 48 into firm abutment with each other, whereby the washer 34 is attached to the front side of the squeegee head 10*a* of the washer attachment component-equipped squeegee 10-3 with no backlash. FIG. 17A (state as viewed from the back side) and FIG. 17B (state as viewed from the front side) illustrate a combination squeegee 63 configured as above (in such a manner that the impregnation body is removed). Here, in Embodiment 2 and Embodiments 3 and 4 described later, as the channel 16 and the washer 34, ones those lengths are smaller than those of Embodiment 1 (including the alteration) are used; however, there is no special technical significance in these length differences.

Embodiment 3

Figure 18:
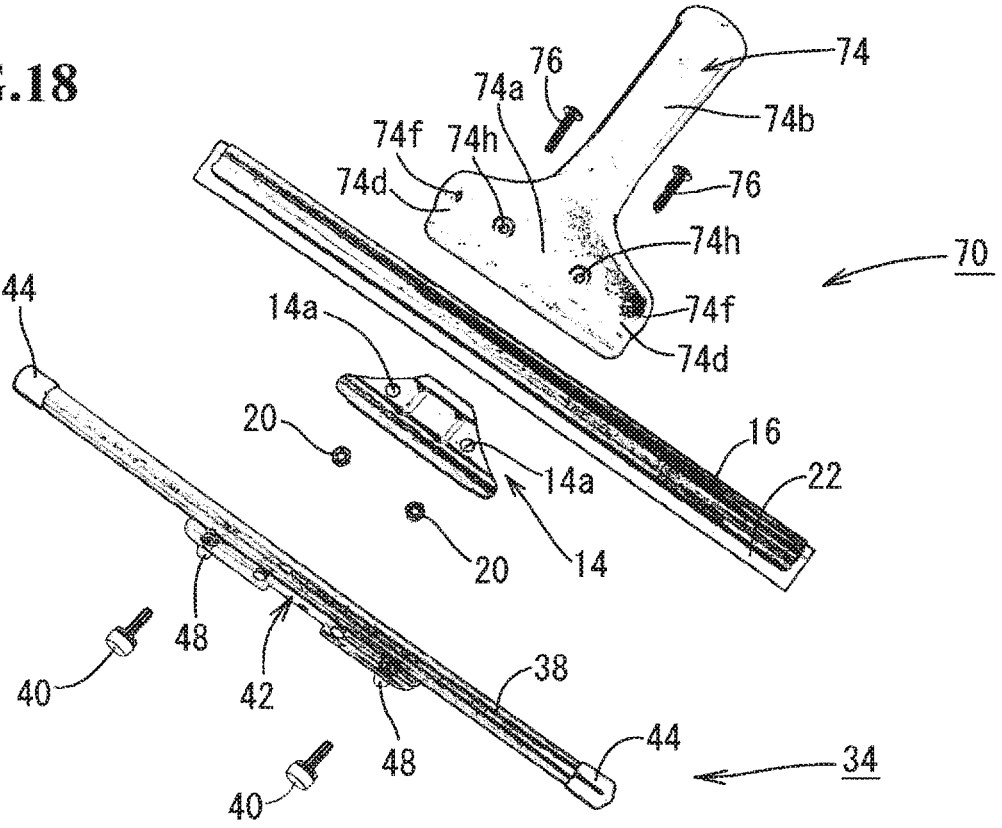
FIG. 18 is a diagram illustrating Embodiment 3 of a squeegee according to this invention, which is a perspective view of a combination squeegee obtained by combination of the squeegee and a washer, as dissembled and viewed from the back side.

Embodiment 3 of this invention will be described. This embodiment provides one in which a washer attachment portion is formed in a component forming a handle of a squeegee itself instead of an independent washer attachment component. For parts that are common with those of Embodiment 1 or 2, reference numerals that are the same as those used in Embodiment 1 or 2 are used. FIG. 18 illustrates components of a combination squeegee obtained by combination of a squeegee 70 and a washer 34 (an impregnation body is not illustrated), according to Embodiment 3. A configuration of the washer 34 is the same as that of the washer 34 in FIGS. 5 to 7. However, a length of the washer 34 in FIG. 18 is smaller than that of the washer 34 in FIGS. 5 to 7 (Embodiment 1) and is equal to that of the washer 34 in FIGS. 16 to 17 (Embodiment 2). Hand screws 40 for attachment of the washer 34 to the squeegee 70 are the same as the hand screws 40 used in Embodiments 1 and 2. In the squeegee 70, a back plate 14, a channel 16 fitted with a rubber 22 and nuts 20 are the same as the respective corresponding ones in the squeegee 10 in FIG. 2. However, a length of the channel 16 is smaller than that of the channel 16 in FIG. 2 (Embodiment 1) and is equal to that of the channel 16 in FIGS. 15 to 17 (Embodiment 2). A handle 74 is unique to Embodiment 3 and forms a washer attachment component. Along with the use of the unique handle 74, for screws 76 for assembling the squeegee 70, ones including a shaft having a length that is larger than that of the screws 18 in FIG. 2 are used.

Figure 19A:
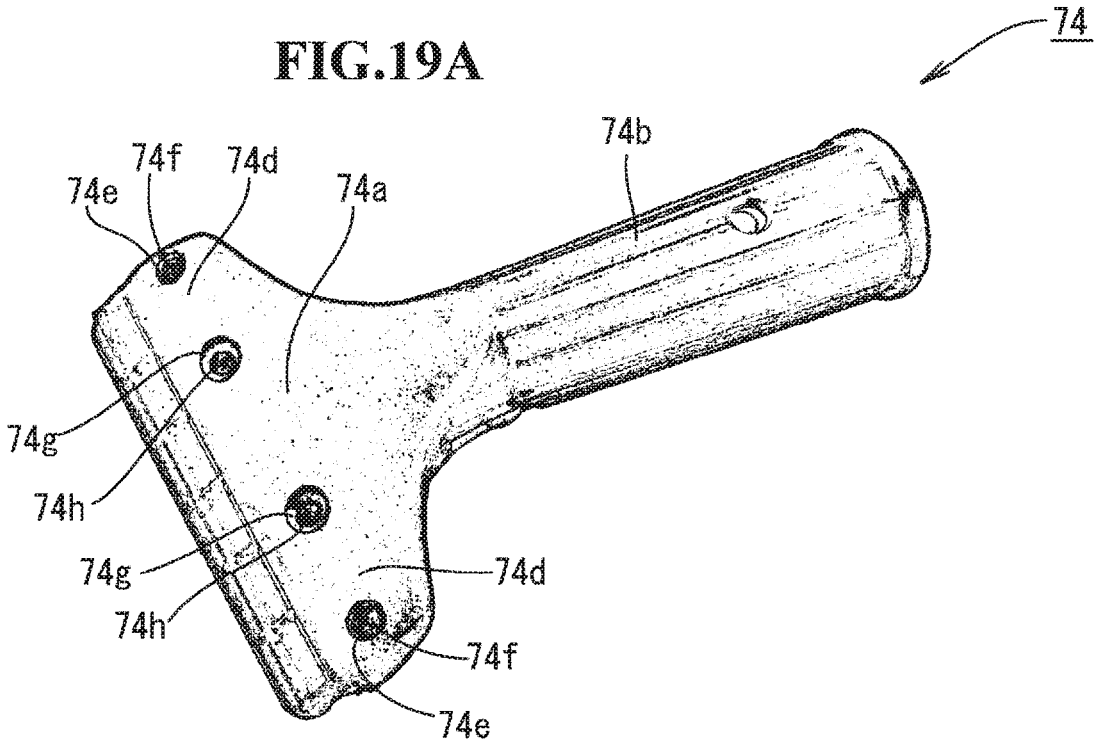
FIG. 19A is a perspective view of the handle in FIG. 18 as viewed from the back side.
Figure 19B:
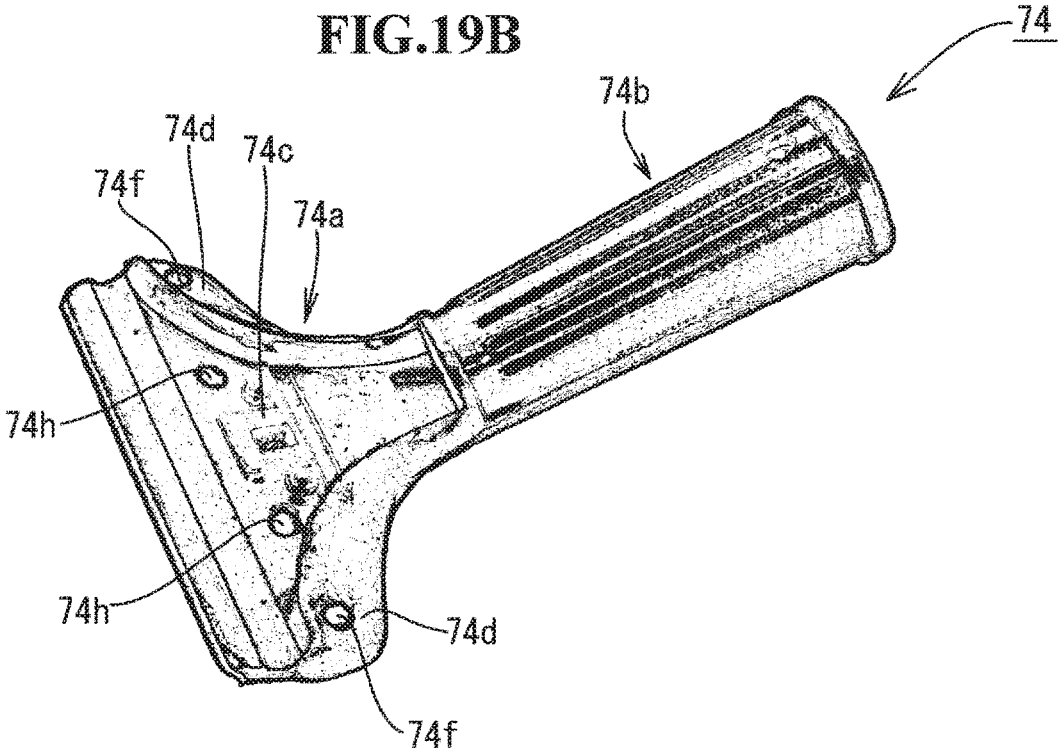
FIG. 19B is a perspective view of the handle in FIG. 19A as viewed from the front side.

FIG. 19A (state as viewed from the back side) and FIG. 19B (state as viewed from the front side) illustrate an enlargement of a structure of the handle 74. Although the handle 74 is indicated here as an integral molding of plastic, the handle 74 can be made of a metal. The handle 74 includes a handle head 74*a* on the front end side and a grip 74*b* on the rear end side. The handle head 74*a* includes a depression 74*c* that receives the back plate 14. On the front end side of a depression 74*c*, the handle head 74*a* includes areas 74*d* and 74*d* extending on opposite, right and left, side of the depression 74*c* (that is, areas not overlapping the back plate 14). On the back side of the areas 74*d* and 74*d*, respective recesses 74*e* and 74*e* are formed. At respective centers of the recesses 74*e* and 74*e*, screw passing holes 74*f* and 74*f*, which each form a washer attachment portion, are formed. On the back side of the handle head 74*a*, recesses 74*g* and 74*g* are formed at respective positions between the screw passing holes 74*f* and 74*f*. At respective centers of the recesses 74*g* and 74*g*, respective screw passing holes 74*h* and 74*h* are formed. The screw passing holes 74*h* and 74*h* are formed at respective positions at which the screw passing holes 74*h* and 74*h* communicate with screw passing holes 14*a* and 14*a* of the back plate 14. A procedure for assembling the handle 74, the back plate 14 and the channel 16 is as follows. The back plate 14 is received in the depression 74*c* on the front side of the handle head 74*a*. The channel 16 is put into a front end between the handle head 74*a* and the back plate 14. Two screws 76 are inserted into the screw passing holes 74*h* and 14*a* sequentially from the back side of the handle 74. Nuts 20 are screwed and fastened to respective ends of the screws 76, the ends projecting on the front side of the back plate 14. Consequently, the handle 74 and the back plate 14 are joined to each other, and the channel 16 is clamped by the front end between the handle head 74*a* and the back plate 14, whereby the handle 74, the back plate 14 and the channel 16 are assembled and integrated in such a manner that disassembling is possible. Consequently, the squeegee 70 illustrated in FIG. 20A (state as viewed from the back side) and FIG. 20B (as viewed from the front side) is configured. The squeegee 70 can be used alone as a simple squeegee without attaching the washer 34 thereto, for removing water from a glass window.

Figure 20A:
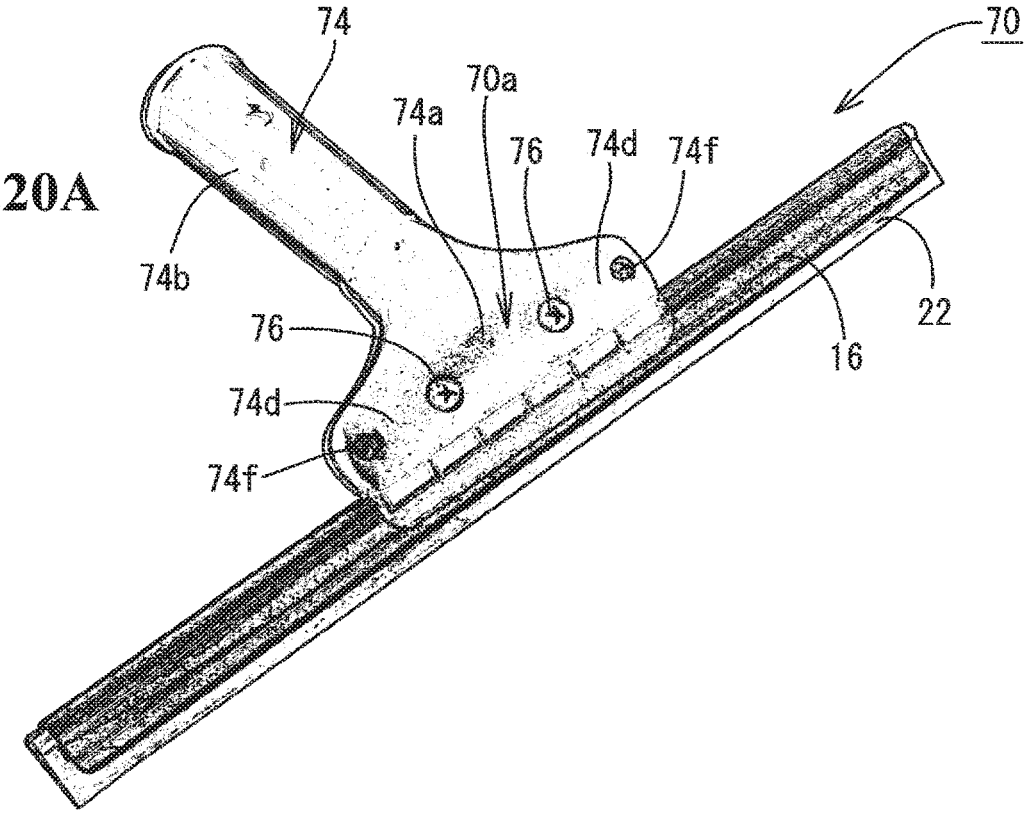
FIG. 20A is a perspective view of the squeegee in FIG. 18 as assembled and viewed from the back side.
Figure 20B:
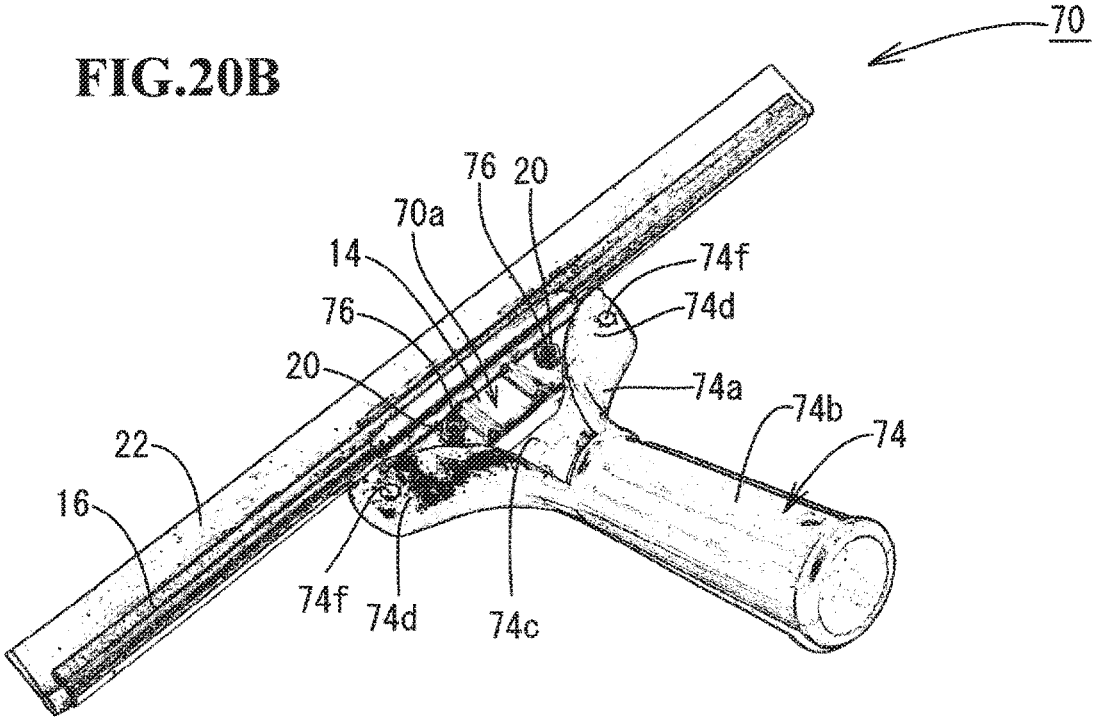
FIG. 20B is a perspective view of the squeegee in FIG. 20A as viewed from the front side.
Figure 21A:
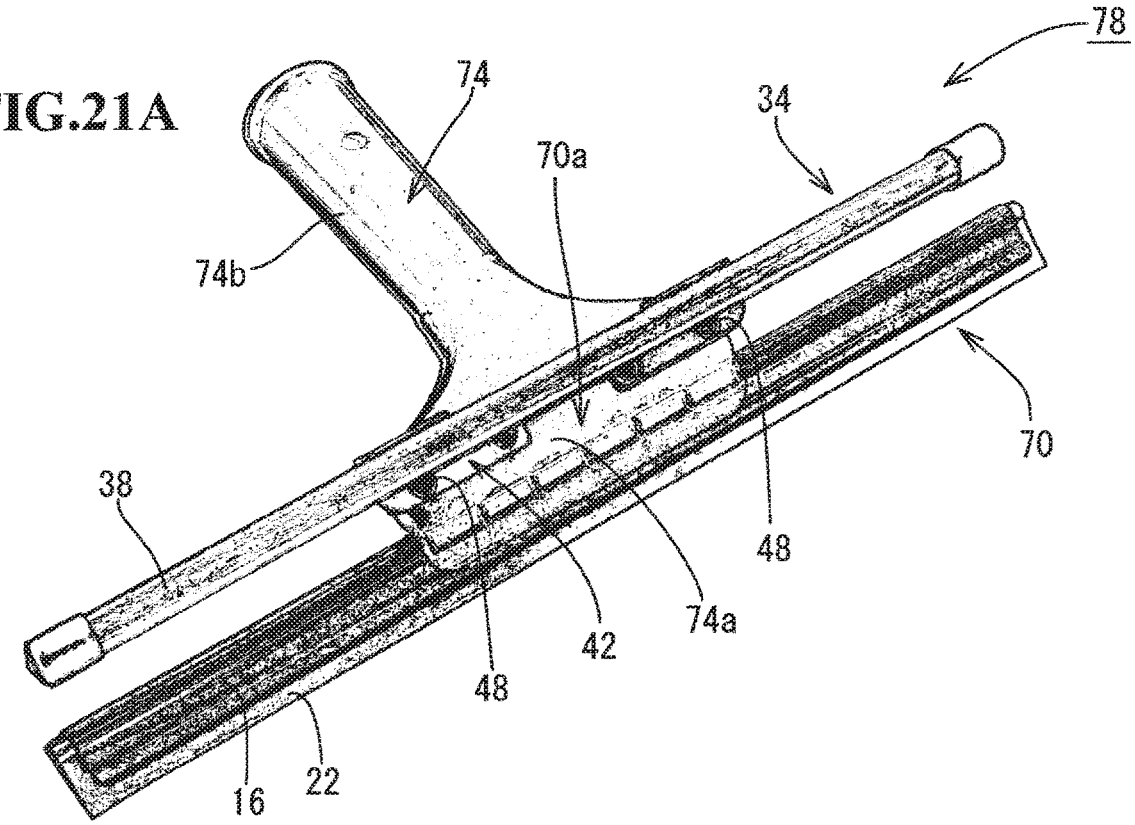
FIG. 21A is a perspective view of a combination squeegee obtained by attachment of the washer in FIG. 18 to the back side of the squeegee in FIGS. 20A and 20B, as viewed from the back side (which is illustrated in such a manner that an impregnation body is removed)
Figure 21B:
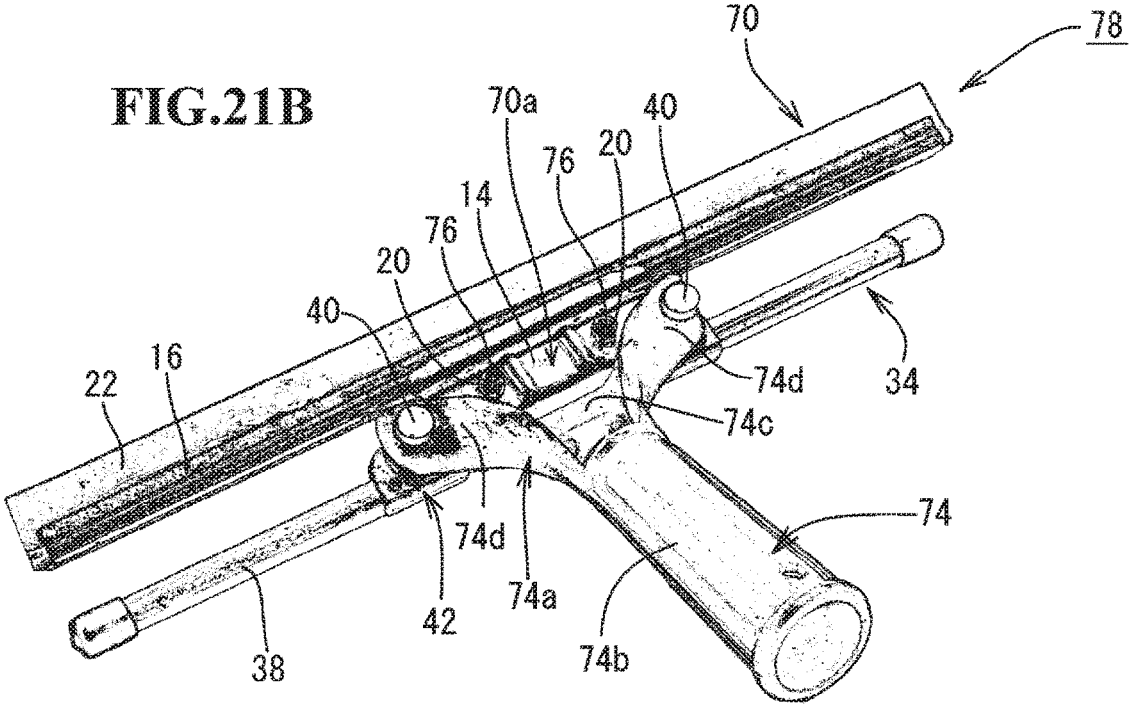
FIG. 21B is a perspective view of the combination squeegee in the state in FIG. 21A as viewed from the front side.
Figure 22A:
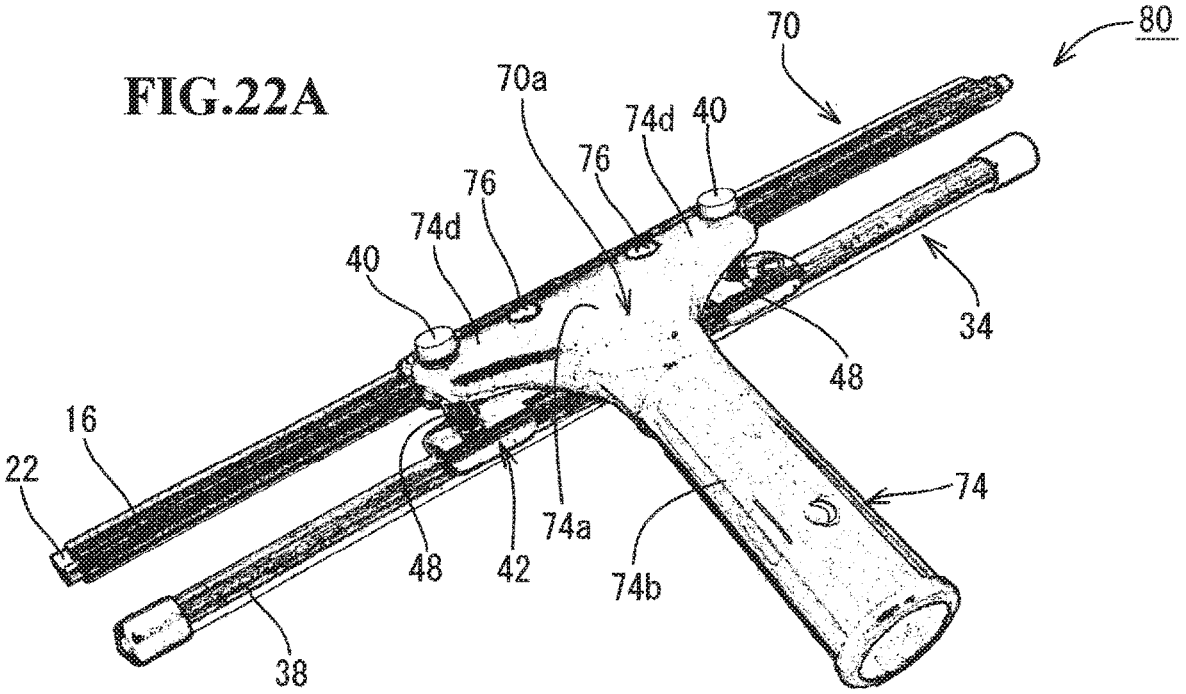
FIG. 22A is a perspective view of a combination squeegee obtained by attachment of the washer in FIG. 18 to the front side of the squeegee in FIGS. 20A and 20B, as viewed from the back side (which is illustrated in such a manner that the impregnation body is removed)
Figure 22B:
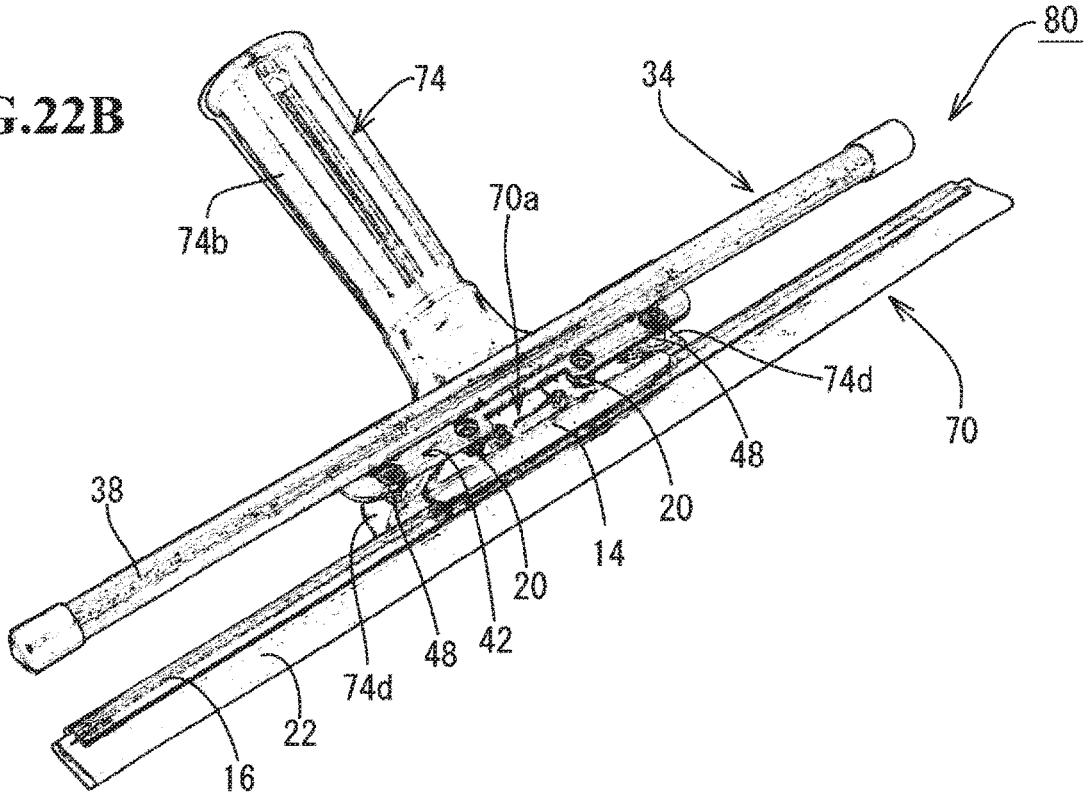
FIG. 22B is a perspective view of the combination squeegee in the state in FIG. 22A as viewed from the front side.

The washer 34 in FIG. 18 is removably attachable to either of the back side and the front side of the squeegee head 70*a* of the squeegee 70 in FIGS. 20A and 20B. A procedure for attaching the washer 34 to the back side of the squeegee 70 is as follows. The washer 34 is disposed on the back side of the squeegee head 70*a* of the squeegee 70. Here, distal ends of female threaded rivets 48 and 48 of the washer 34 are received and positioned in the respective recesses 74*e* and 74*e* of the handle head 74*a*. The hand screws 40 and 40 are inserted into the screw passing holes 74*f* and 74*f* from the front side of the squeegee 70 and screwed into the female threaded rivets 48 and 48 and fastened. Consequently, the washer 34 is attached to the back side of the squeegee head 70*a* of the squeegee 70 with no backlash. FIG. 21A (state as viewed from the back side) and FIG. 21B (state as viewed from the front side) illustrate a combination squeegee 78 configured as above (in such a manner that the impregnation body is removed). Also, a procedure for attaching the washer 34 to the front side of the squeegee 70 is as follows. The washer 34 is disposed on the front side of the squeegee head 70*a* of the squeegee 70. The hand screws 40 and 40 are inserted into the screw passing holes 74*f* and 74*f* from the back side of the squeegee 70, and screwed into the female threaded rivets 48 and 48 and fastened. Consequently, the washer 34 is attached to the front side of the squeegee head 70*a* of the squeegee 70 with no backlash. FIG. 22A (state as viewed from the back side) and FIG. 22B (state as viewed from the front side) illustrate a combination squeegee 80 configured as above (in such a manner that the impregnation body is removed).

Embodiment 4

Figure 23:
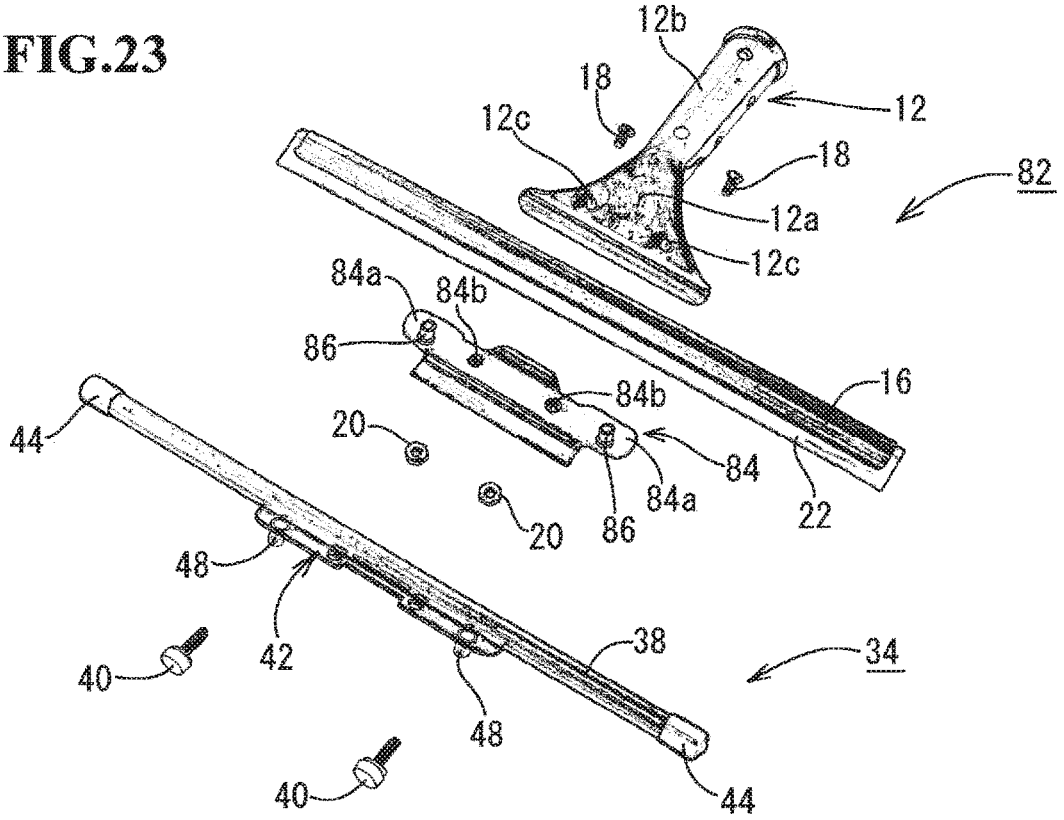
FIG. 23 is a diagram illustrating Embodiment 4 of a squeegee according to this invention, which is a perspective view of a combination squeegee obtained by combination of the squeegee and a washer, as dissembled and viewed from the back side.

Embodiment 4 of this invention will be described. This embodiment provides one in which a washer attachment portion is formed in a component forming a back plate of a squeegee itself instead of an independent washer attachment component. For parts that are common with those of Embodiment 1, 2 or 3, reference numerals that are the same as those used in Embodiment 1, 2 or 3 are used. FIG. 23 illustrates components of a combination squeegee obtained by combination of a squeegee 82 and a washer 34 (an impregnation body is not illustrated), according to Embodiment 4. A configuration of the washer 34 is the same as that of the washer 34 in FIGS. 5 to 7 (Embodiment 1). However, a length of the washer 34 in FIG. 23 is smaller than that of the washer 34 in FIGS. 5 to 7 (Embodiment 1) and is equal to that of the washers 34 in FIGS. 16 to 17 (Embodiment 2) and FIGS. 21 to 22 (Embodiment 3). Hand screw 40 for attachment of the washer 34 to the squeegee 82 are the same as the hand screws 40 used in Embodiments 1, 2 and 3. For the squeegee 82, a handle 12, a channel 16 fitted with a rubber 22, screws 18 and nuts 20 are the same as the respective corresponding ones in the squeegee 10 in FIG. 2. However, a length of the channel 16 is smaller than that of the channel 16 in FIG. 2 (Embodiment 1) and is equal to that of the channel 16 in FIGS. 15 to 17 (Embodiment 2) and also to that of the channel 16 in FIGS. 20 to 22 (Embodiment 3). The back plate 84 is one unique to Embodiment 4 and forms a washer attachment component.

Figure 24A:
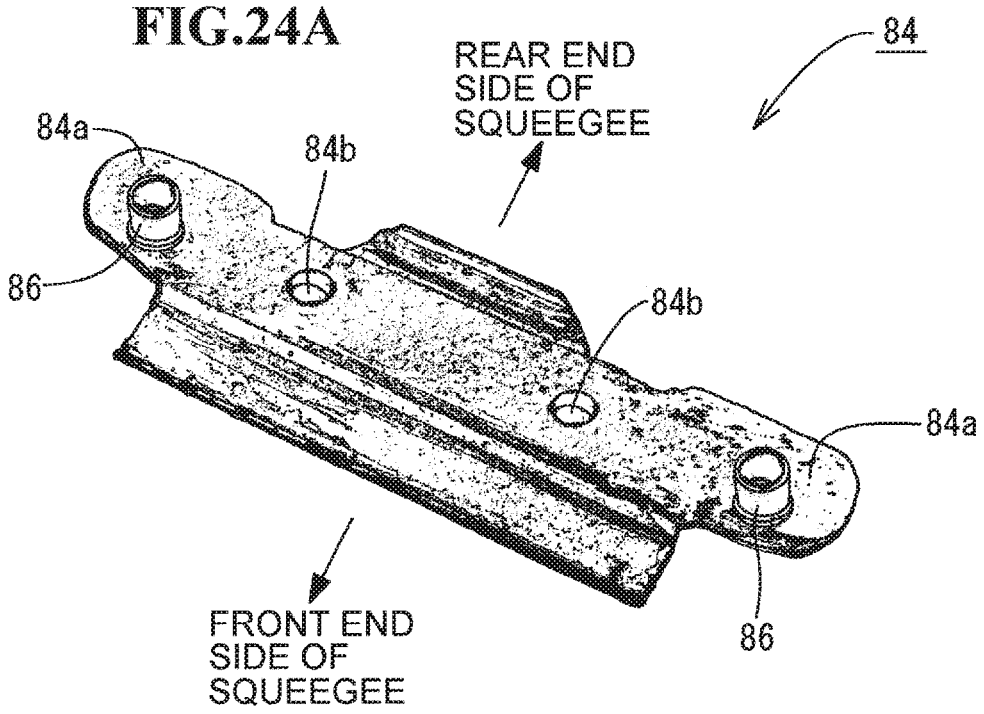
FIG. 24A is a perspective view of the back plate in FIG. 23 as viewed from the back side (side facing a handle head)
Figure 24B:
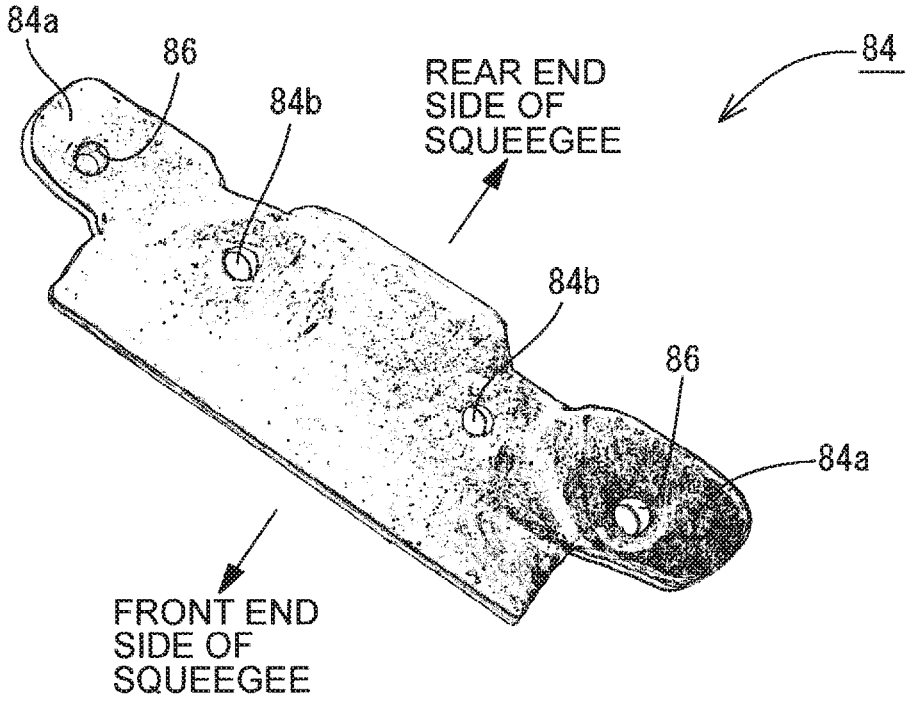
FIG. 24B is a perspective view of the back plate in FIG. 24A as viewed from the front side.

FIG. 24A (state as viewed from the back side, that is, the side facing a handle head 12*a*) and FIG. 24B (state as viewed from the front side) illustrate an enlargement of a structure of the back plate 84. The back plate 84 here is formed of a metal plate of, e.g., a stainless steel. The back plate 84 includes areas 84*a* and 84*a* extending on opposite, right and left, side relative to the handle head 12*a* (that is, areas not overlapping the handle head 12*a*). In the areas 84*a* and 84*a*, respective non-female threaded rivets 86 and 86, which each form a washer attachment portion, are disposed so as to project on the back side of the squeegee 82, that is, the side facing the handle head 12*a*. In the back plate 84, screw passing holes 84*b* and 84*b* are formed at respective positions between the non-female threaded rivets 86 and 86. The screw passing holes 84*b* and 84*b* are formed at the respective positions at which the screw passing holes 84*b* and 84*b* communicate with screw passing holes 12*c* and 12*c* of the handle head 12*a*. A procedure for assembling the handle 12, the back plate 84 and the channel 16 is as follows. The back plate 84 is disposed on the front side of the handle head 12*a*. The channel 16 is put into a front end between the handle head 12*a* and the back plate 84. The two screws 18 are inserted into the respective screw passing holes 12*c* and 84*b* sequentially from the back side of the handle 12. The nuts 20 are screwed and fastened to respective ends of the screws 18, the ends projecting on the front side of the back plate 84. Consequently, the handle 12 and the back plate 84 are joined to each other, and the channel 16 is clamped by the front end between the handle head 12*a* and the back plate 84, whereby the handle 12, the back plate 84 and the channel 16 are assembled and integrated in such a manner that disassembling is possible. Consequently, the squeegee 82 illustrated in FIG. 25A (state as viewed from the back side) and FIG. 25B (state as viewed from the front side) is configured. The squeegee 82 can be used alone as a simple squeegee without attaching the washer 34 thereto, for removing water from a glass window.

Figure 25A:
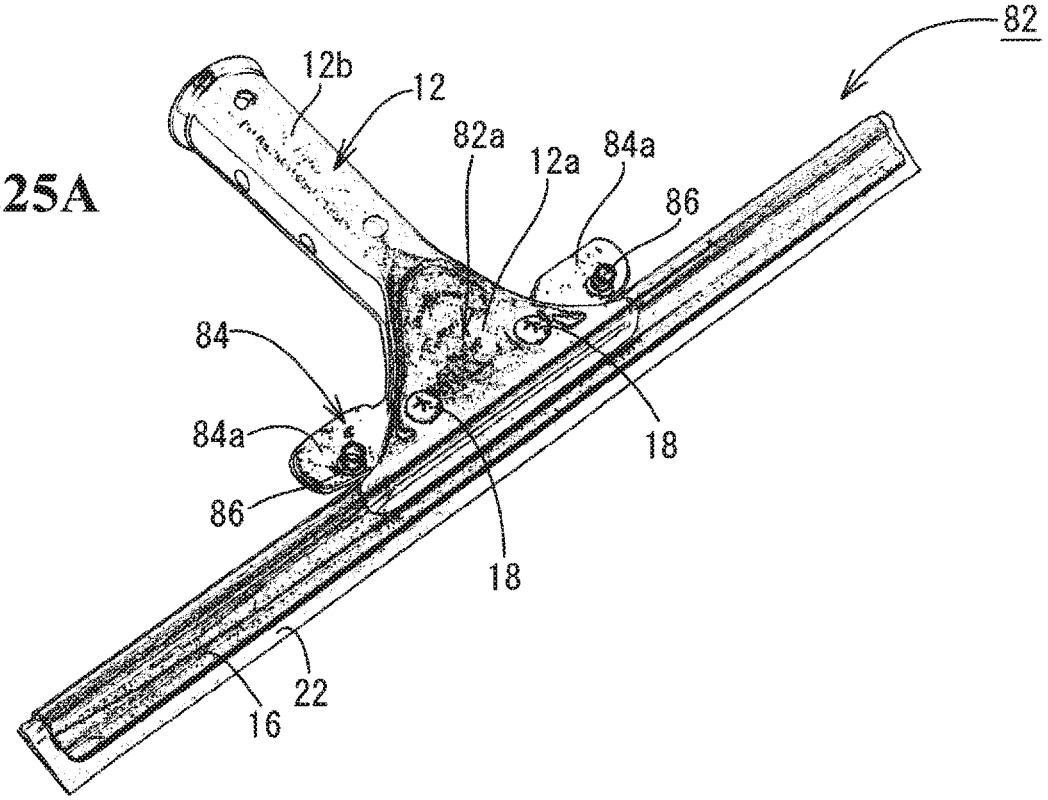
FIG. 25A is a perspective view of the squeegee in FIG. 23 as assembled and viewed from the back side.
Figure 25B:
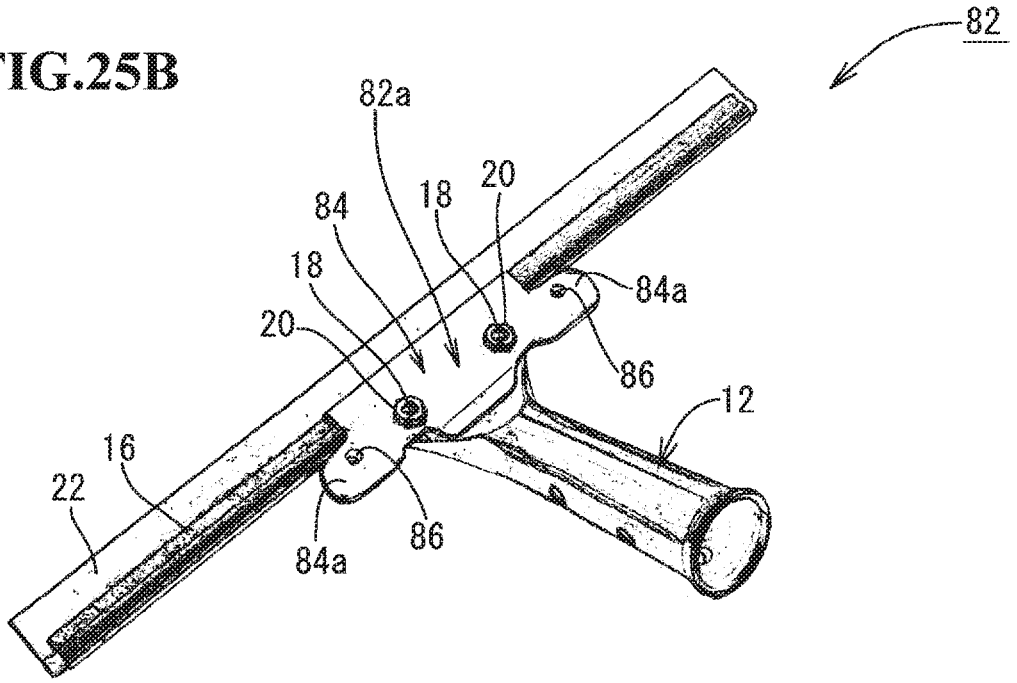
FIG. 25B is a perspective view of the squeegee in FIG. 25A as viewed from the front side.
Figure 26A:
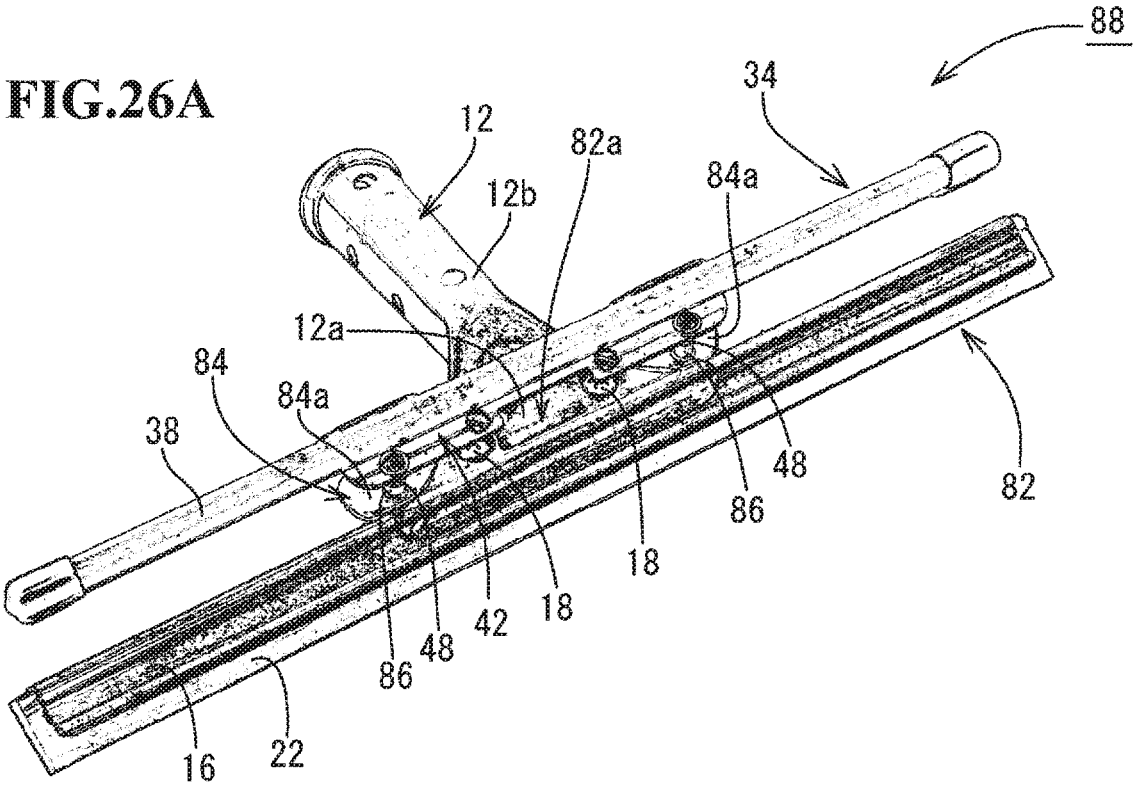
FIG. 26A is a perspective view of a combination squeegee obtained by attachment of the washer in FIG. 23 to the back side of the squeegee in FIGS. 25A and 25B, as viewed from the back side (which is illustrated in such a manner that an impregnation body is removed)
Figure 26B:
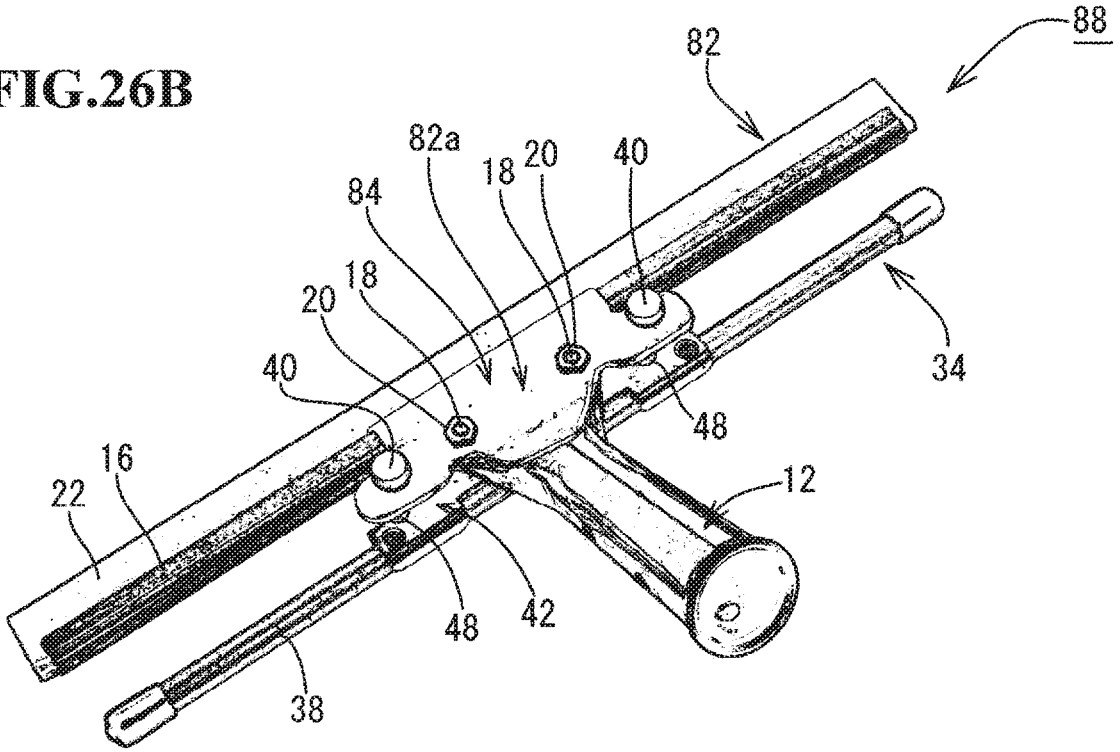
FIG. 26B is a perspective view of the combination squeegee in the state in FIG. 26A as viewed from the front side.
Figure 27A:
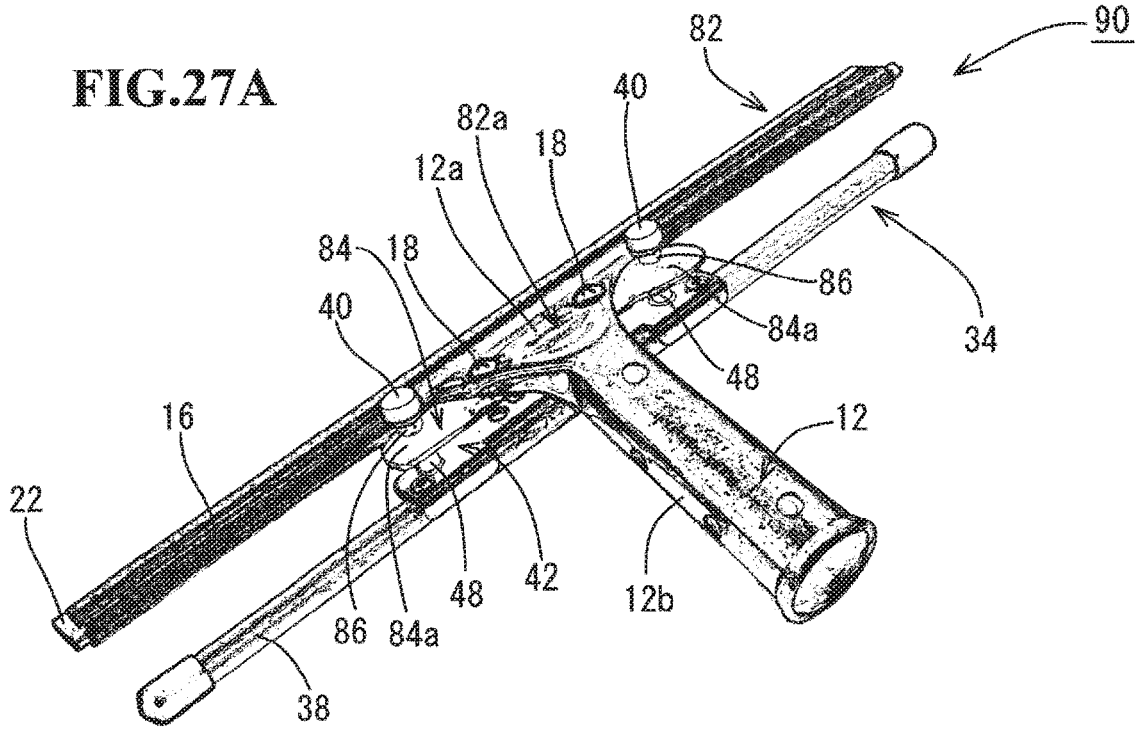
FIG. 27A is a perspective view of a combination squeegee obtained by attachment of the washer in FIG. 23 to the front side of the squeegee in FIGS. 25A and 25B as viewed from the back side (which is illustrated in such a manner that the impregnation body is removed)
Figure 27B:
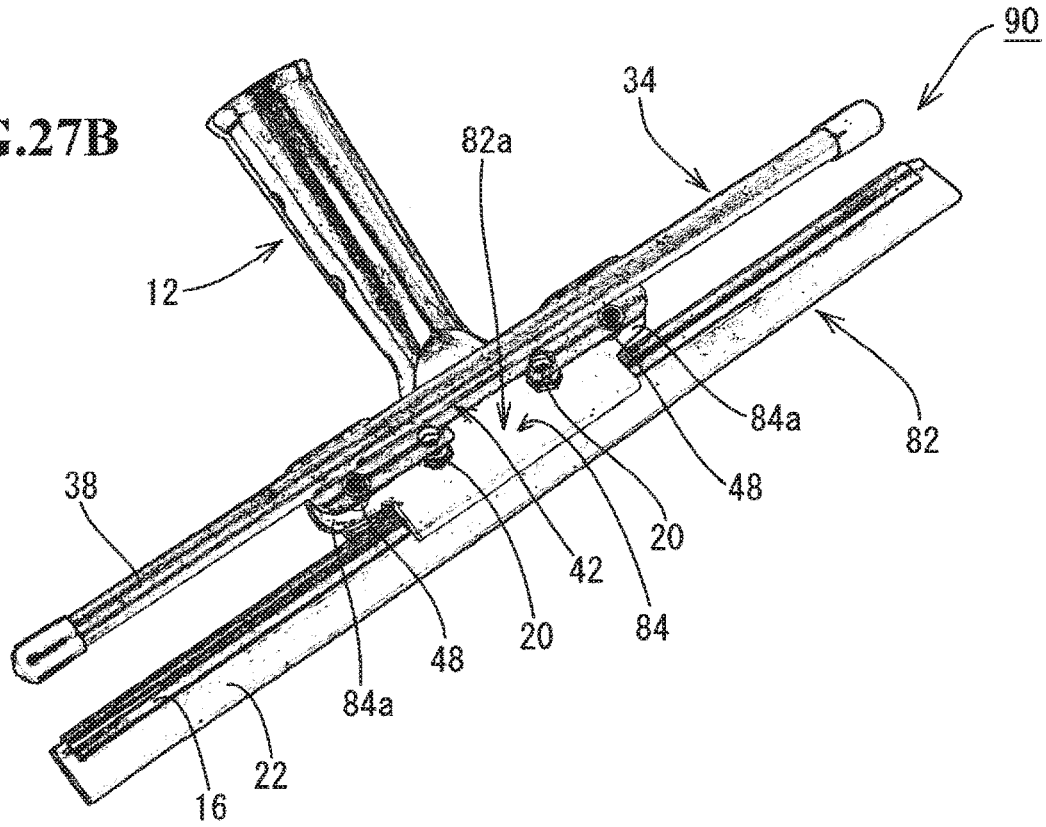
FIG. 27B is a perspective view of the combination squeegee in the state in FIG. 27A as viewed from the front side.

The washer 34 in FIG. 23 is removably attachable to either of the back side and the front side of a squeegee head 82*a* of the squeegee 82 in FIGS. 25A and 25B. A procedure for attaching the washer 34 to the back side of the squeegee 82 is as follows. The washer 34 is disposed on the back side of the squeegee head 82*a* of the squeegee 82. Here, distal ends of female threaded rivets 48 and 48 of the washer 34 are brought into abutment with respective distal ends of the non-female threaded rivets 86 and 86, whereby hollows of the female threaded rivets 48 and 48 and hollows of the non-female threaded rivets 86 and 86 communicate with each other. Hand screws 40 and 40 are inserted into the non-female threaded rivets 86 and 86 from the front side of the squeegee 82, and screwed into the female threaded rivets 48 and 48 and fastened. Consequently, the washer 34 is attached to the back side of the squeegee head 82*a* of the squeegee 82 with no backlash. FIG. 26A (state as viewed from the back side) and FIG. 26B (state as viewed from the front side) illustrate a combination squeegee 88 configured as above (in such a manner that the impregnation body is removed). Also, a procedure for attaching the washer 34 to the front side of the squeegee 82 is as follows. The washer 34 is disposed on the front side of the squeegee head 82*a* of the squeegee 82. Here, the respective distal ends of the female threaded rivets 48 and 48 of the washer 34 are brought into abutment with respective proximal ends of the non-female threaded rivets 86 and 86, the proximal ends being exposed in a surface on the front side of the back plate 84, whereby the hollows of the female threaded rivets 48 and 48 and the hollows of the non-female threaded rivets 86 and 86 communicate with each other. The hand screws 40 and 40 are inserted into the non-female threaded rivets 86 and 86 from the back side of the squeegee 82, and screwed into the female threaded rivets 48 and 48 and fastened. Consequently, the washer 34 is attached to the front side of the squeegee head 82*a* of the squeegee 82 with no backlash. FIG. 27A (state as viewed from the back side) and FIG. 27B (state as viewed from the front side) illustrate a combination squeegee 90 configured as above (in such a manner that the impregnation body is removed).

Figure 10B:
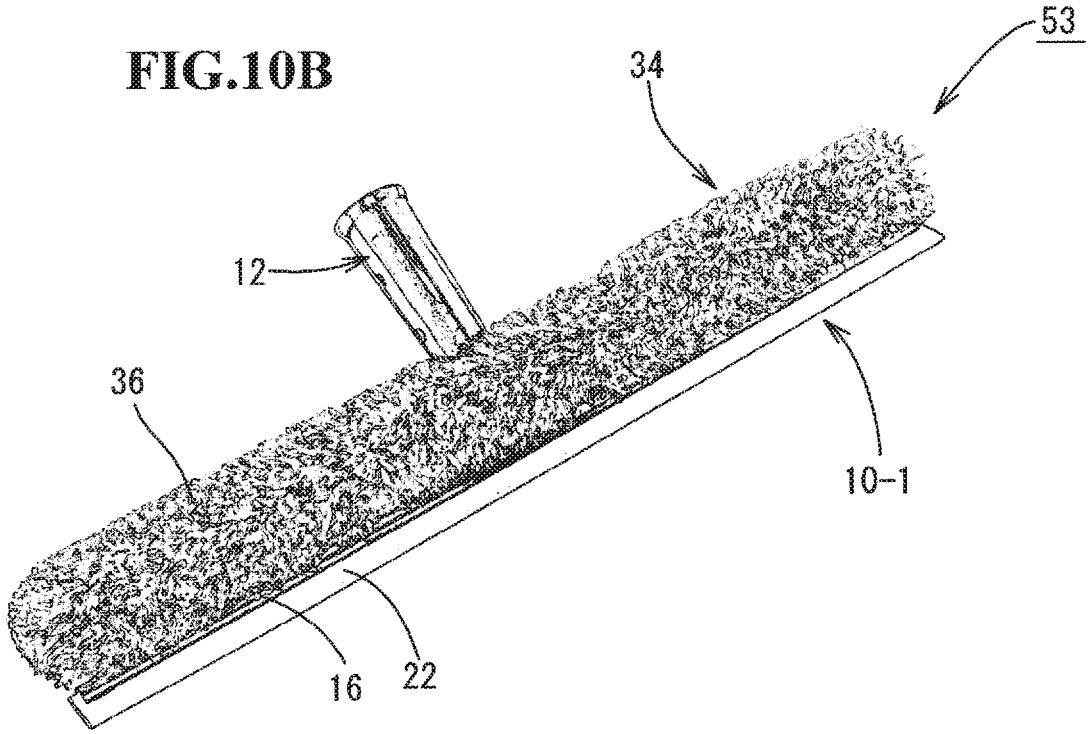
FIG. 10B is a perspective view of the combination squeegee in FIG. 10A as viewed from the front side.

<<Alteration of Combination Squeegee 53 in FIGS. 10A and 10B>>

Figure 30:
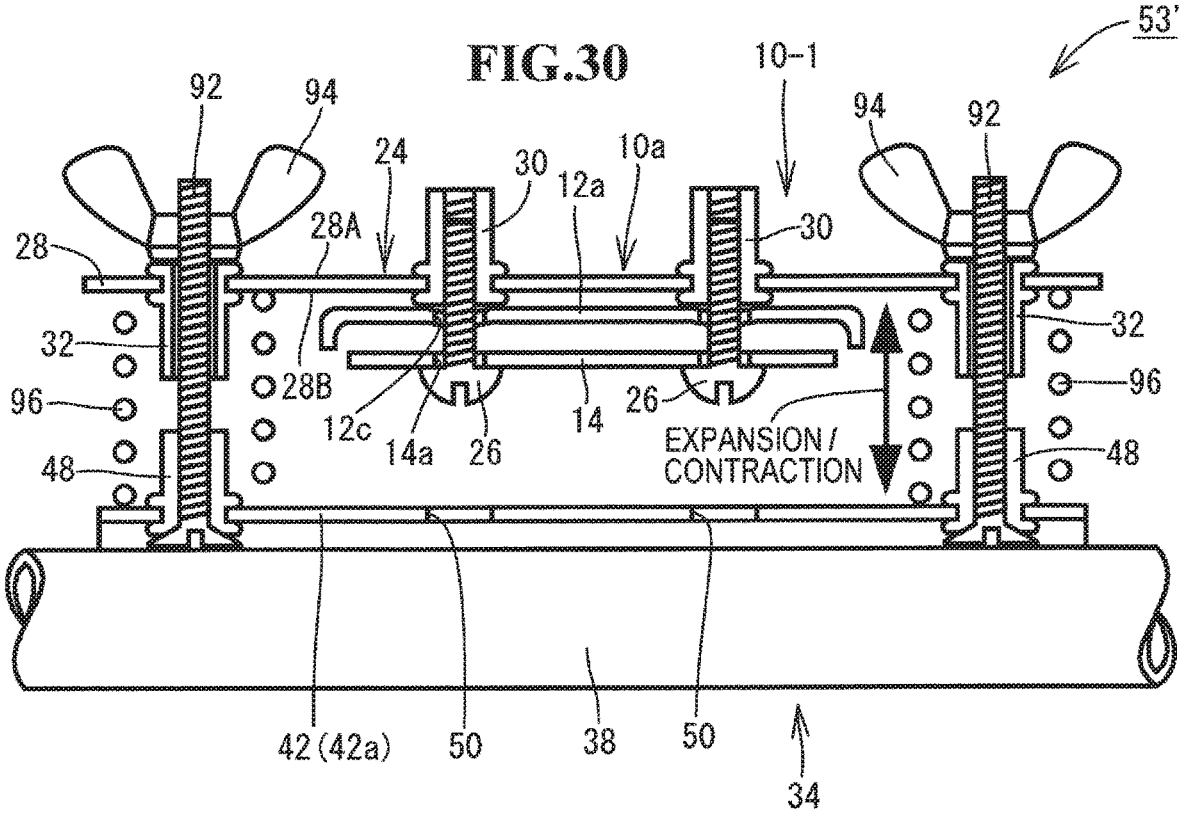
FIG. 30 is a diagram illustrating an alteration of the combination squeegee in FIGS. 10A and 10B in which a distance between a squeegee and a washer is made to be adjustable, which is a cross-sectional view along an arrow at a position corresponding to the position of arrow II-II in FIG. 10A.

FIG. 30 illustrates an alteration of the combination squeegee 53 in FIGS. 10A and 10B. This combination squeegee 53' is one in which a distance between the squeegee 10-1 of the combination squeegee 53 in FIGS. 10A and 10B and the washer 34 is made to be adjustable. FIG. 30 illustrates a cross-section of the combination squeegee 53' along an arrow at a position corresponding to the position of the arrow for the cross-section of the combination squeegee 53 illustrated in FIG. 29 (cross-section along arrow II-II in FIG. 10A). As can be seen from comparison between FIGS. 29 and 30, in the combination squeegee 53', long screws 92, butterfly nuts 94 and coil springs 96 are disposed instead of the hand screws 40 in the combination squeegee 53. The screws 92 are screwed into the respective female threaded rivets 48 of the washer 34 from the proximal end side of the respective female threaded rivets 48 and fixed to the respective female threaded rivets 48. Shafts of the screws 92 project long from the respective distal ends of the female threaded rivets 48. The projecting shafts of the screws 92 are inserted through the non-female threaded rivets 32 of the washer attachment component 24 and project on the surface 28A side of the plate 28. The butterfly nuts 94 are screwed to respective parts of the shafts of the screws 92, the parts projecting on the surface 28A side. Between the base portion 42*a* of the support base 42 of the washer 34 and the washer attachment component 24, the coil springs 96 are provided in a compressed state, coaxially with the screws 92. The coil springs 96 surround the screws 92, the female threaded rivets 48 and the non-female threaded rivets 32, respectively. With the above configuration, upon rotation of the right and left butterfly nuts 94 and 94 equally, the coil springs 96 expand/contract. Along with the expansion/contraction of the coil springs 96, a distance between the base portion 42*a* and the washer attachment component 24 changes with the base portion 42*a* of the support base 42 and the washer attachment component 24 kept in parallel to each other. As a result, a distance between the squeegee 10-1 and the washer 34 is adjusted. As described above, a user of the combination squeegee 53' adjusts the distance between the squeegee 10-1 and the washer 34 so that the user can easily use the combination squeegee 53'. Then, the user can use the combination squeegee 53' in a usage mode in which washing via the washer 34 and water removal via the squeegee 10-1 are performed at a time, in the adjusted state. Use of strong springs for the coil springs 96 enables washing to be performed with the distance between the squeegee 10-1 and the washer 34 kept as the adjusted distance irrespective of a force pushing a glass surface. On the other hand, use of weak springs for the coil springs 96 enables usage in which washing is performed while the distance between the squeegee 10-1 and the washer 34 slightly changing according to the force pushing a glass surface.

Here, in each of the embodiments described above, screw passing holes are provided in respective washer attachment portions (the non-female threaded rivets 32, 66 or 86 or the screw passing holes 74*f*), female threads (the female threaded rivets 48) are provided in a washer, and screws (the hand screws 40) are inserted through the screw passing holes of the washer attachment portions and screwed into the female threads of the washer, whereby the washer is attached to the squeegee. In a manner opposite to this, it is possible that screw passing holes are provided in a washer, female threads are provided in the washer attachment portions, and screws are inserted through the screw passing holes of the washer and screwed into the female threads in the washer attachment portions, whereby the washer is attached to the squeegee. Or, it is also possible that screw passing holes are provided in each of a washer attachment portion and a washer, and screws are inserted through both screw passing holes, and nuts are screwed to respective ends of the screws, the ends being exposed from the screw passing holes, whereby the washer is attached to the squeegee.

What is claimed is:

1. A squeegee including a handle that includes a handle head on a front end side and a grip on a rear end side, a back plate attached to a front side of the handle head, a channel holding a rubber and clamped between the handle head and the back plate in a clamping direction, wherein the clamping direction extends generally perpendicular to a plane in which the back plate is oriented, wherein a part of the squeegee on the front end side relative to the grip, excluding the channel, defines a squeegee head, the squeegee further comprising:

a washer attachment portion configured to have a core member of a washer removeably attached thereto such that the core member, which is provided to support an impregnation body of the washer, is attachable and detachable from the squeegee head, via the washer attachment portion, in a state in which the back plate is attached to the handle head, wherein the washer attachment portion is provided in an area of the squeegee head that is outside of an overlapping area in which the handle head and the back plate overlap each other when viewed from the clamping direction such that the washer attachment portion and the overlapping area are not superposed when viewed from the clamping direction, wherein the grip at the rear end side of the squeegee when the washer is not attached to the squeegee is configured to provide a same grip at the rear end side of the washer when the washer is attached to the squeegee.

2. The squeegee according to claim 1, wherein the washer attachment portion includes a screw passing hole that allows a screw for attaching the washer to the squeegee head, to be inserted therethrough, or a threaded hole that allows the screw to be screwed thereinto.

3. A washer attachment component comprising the washer attachment portion of the squeegee according to claim 1, wherein the washer attachment component is attached to the squeegee head and thereby forms a part of the squeegee head, and wherein the washer attachment component is configured to removably attach the core member of the washer thereto via the washer attachment portion.

4. The washer attachment component according to claim 3, wherein:

the washer attachment component includes a squeegee attachment portion that enables attachment of the washer attachment component to the squeegee head, in addition to the washer attachment portion; and the washer attachment portion enables attachment of the washer to the washer attachment component in a state in which the washer attachment component is attached to the squeegee head via the squeegee attachment portion.

5. The washer attachment component according to claim 3, wherein:

the washer attachment component includes right and left extensions forming respective areas extending on opposite, right and left, sides of the handle head and the back plate, respectively, in a state in which the washer attachment component is attached to the squeegee head; and each of the right and left extensions includes the washer attachment portion.

6. The washer attachment component according to claim 3, wherein the washer attachment component is attached to the squeegee in such a manner that the washer attachment component is disposed on a back side of the handle head that is a surface side opposite to a surface of the handle head, the surface facing the back plate, is disposed between the handle head and the back plate or is disposed on a front side of the back plate that is a surface side opposite to a surface of the back plate, the surface facing the handle head.

7. The handle of the squeegee according to claim 1, wherein the handle includes the washer attachment portion.

8. A squeegee including a handle that includes a handle head on a front end side and a grip on a rear end side, a back plate attached to a front side of the handle head, a channel holding a rubber and clamped between the handle head and the back plate in a clamping direction, wherein the clamping direction extends generally perpendicular to a plane in which the back plate is oriented, wherein a part of the squeegee on the front end side relative to the grip, excluding the channel, defines a squeegee head, the squeegee further comprising:

a washer attachment portion configured to have a core member of a washer removeably attached thereto such that the core member, which is provided to support an impregnation body of the washer, is attachable and detachable from the squeegee head, via the washer attachment portion, in a state in which the back plate is attached to the handle head, wherein the washer attachment portion is provided in an area of the squeegee head that is outside of an overlapping area in which the handle head and the back plate overlap each other when viewed from the clamping direction such that the washer attachment portion and the overlapping area are not superposed when viewed from the clamping direction, wherein the washer attachment component is attached to the squeegee head and thereby forms a part of the squeegee head, and wherein the washer attachment component is configured to removably attach the core member of the washer thereto via the washer attachment portion, wherein the washer attachment component includes a part that allows attachment of the washer attachment component to the squeegee along with attachment of the back plate to the handle head.

9. A squeegee including a handle that includes a handle head on a front end side and a grip on a rear end side, a back plate attached to a front side of the handle head, a channel holding a rubber and clamped between the handle head and the back plate in a clamping direction, wherein the clamping direction extends generally perpendicular to a plane in which the back plate is oriented, wherein a part of the squeegee on the front end side relative to the grip, excluding the channel, defines a squeegee head, the squeegee further comprising:

a washer attachment portion configured to have a core member of a washer removeably attached thereto such that the core member, which is provided to support an impregnation body of the washer, is attachable and detachable from the squeegee head, via the washer attachment portion, in a state in which the back plate is attached to the handle head, wherein the washer attachment portion is provided in an area of the squeegee head that is outside of an overlapping area in which the handle head and the back plate overlap each other when viewed from the clamping direction such that the washer attachment portion and the overlapping area are not superposed when viewed from the clamping direction, wherein the back plate includes the washer attachment portion.

10. A washer attachment component for enabling attachment of a washer to a squeegee, the washer attachment component comprising a squeegee attachment portion and a washer attachment portion, wherein the washer attachment component is configured to removably attach a core member of the washer, which is provided to support an impregnation body of the washer, thereto via the washer attachment portion, the squeegee attachment portion enabling attachment of the washer attachment component to the squeegee via the squeegee attachment portion in a state in which the core member is not attached to the washer attachment component; and the washer attachment portion enabling attachment of the washer to the washer attachment component via the washer attachment portion in a state in which the washer attachment component is attached to the squeegee via the squeegee attachment portion, wherein the squeegee attachment portion and the washer attachment portion are spaced apart from each other so as not to overlap with respect to an elongated direction of the washer attachment component, wherein the washer attachment component is attachable to the squeegee including a handle that includes a handle head on a front end side and a grip on a rear end side, a back plate attached to a front side of the handle head, a channel holding a rubber and clamped between the handle head and the back plate in a clamping direction, wherein the clamping direction extends generally perpendicular to a plane in which the back plate is oriented, wherein the squeegee attachment portion is provided inside of an overlapping area in which the handle head and the back plate overlap each other when viewed from the clamping direction and the washer attachment portion is provided outside of the overlapping area such that the washer attachment portion and overlapping area are not superposed when viewed from the clamping direction, in a state in which the washer attachment component is attached to the squeegee.

11. The washer attachment component according to claim 10, wherein the washer attachment component includes a part that allows attachment of the washer attachment component to the squeegee via the squeegee attachment portion, along with attachment of the back plate to the handle head.

12. A washer attachment component for enabling attachment of a washer to a squeegee, the washer attachment component comprising a squeegee attachment portion and a washer attachment portion, the squeegee attachment portion enabling attachment of the washer attachment component to the squeegee via the squeegee attachment portion in a state in which the washer is not attached to the washer attachment component; and the washer attachment portion enabling attachment of the washer to the washer attachment component via the washer attachment portion in a state in which the washer attachment component is attached to the squeegee via the squeegee attachment portion, wherein the squeegee attachment portion and the washer attachment portion are spaced apart from each other so as not to overlap with respect to an elongated direction of the washer attachment component, wherein the washer attachment component is attachable to the squeegee including a handle that includes a handle head on a front end side and a grip on a rear end side, a back plate attached to a front side of the handle head, a channel holding a rubber and clamped between the handle head and the back plate, wherein the squeegee attachment portion is provided inside of an area in which the handle head and the back plate overlap each other and the washer attachment portion is provided outside of the area, in a state in which the washer attachment component is attached to the squeegee, wherein the washer attachment component comprises first and second opposed surfaces, wherein at least a first protrusion projects from the first opposed surface to define the squeegee attachment portion, and wherein at least a second protrusion projects from the second opposed surface to define the washer attachment portion.

13. The washer attachment component according to claim 12, wherein the first protrusion comprises a pair of spaced apart protrusions projecting from a plane in which the first opposed surface is oriented, and wherein the second protrusion comprises a pair of spaced apart protrusions projecting from a plane in which the second opposed surface is oriented.

14. The washer attachment component according to claim 13, wherein the spaced apart protrusions of the squeegee attachment portion are positioned between the spaced apart protrusions of the washer attachment portion with respect to the elongated direction of the washer attachment component.

15. A washer attachment component for enabling attachment of a washer to a squeegee, the washer attachment component comprising a squeegee attachment portion and a washer attachment portion, the squeegee attachment portion enabling attachment of the washer attachment component to the squeegee via the squeegee attachment portion in a state in which the washer is not attached to the washer attachment component; and the washer attachment portion enabling attachment of the washer to the washer attachment component via the washer attachment portion in a state in which the washer attachment component is attached to the squeegee via the squeegee attachment portion, wherein the squeegee attachment portion and the washer attachment portion are spaced apart from each other so as not to overlap with respect to an elongated direction of the washer attachment component, wherein the washer attachment component is attachable to the squeegee including a handle that includes a handle head on a front end side and a grip on a rear end side, a back plate attached to a front side of the handle head, a channel holding a rubber and clamped between the handle head and the back plate, wherein the squeegee attachment portion is provided inside of an area in which the handle head and the back plate overlap each other and the washer attachment portion is provided outside of the area, in a state in which the washer attachment component is attached to the squeegee, wherein the washer attachment component comprises first and second opposed surfaces, wherein at least a through hole passes through between the first and the second opposed surfaces to define the squeegee attachment portion, and wherein at least a protrusion projects from the second opposed surface to define the washer attachment portion.

16. The washer attachment component according to claim 15, wherein the through hole comprises a pair of spaced apart through holes passing through between the first and the second opposed surfaces, and wherein the protrusion comprises a pair of spaced apart protrusions projecting from a plane in which the second opposed surface is oriented.

17. The washer attachment component according to claim 16, wherein the spaced apart through holes of the squeegee attachment portion are positioned between the spaced apart protrusions of the washer attachment portion with respect to the elongated direction of the washer attachment component.

18. A washer attachment component for enabling attachment of a washer to a squeegee, the washer attachment component comprising a squeegee attachment portion and a washer attachment portion, the squeegee attachment portion enabling attachment of the washer attachment component to the squeegee via the squeegee attachment portion in a state in which the washer is not attached to the washer attachment component; and the washer attachment portion enabling attachment of the washer to the washer attachment component via the washer attachment portion in a state in which the washer attachment component is attached to the squeegee via the squeegee attachment portion, wherein the squeegee attachment portion and the washer attachment portion are spaced apart from each other so as not to overlap with respect to an elongated direction of the washer attachment component, wherein the washer attachment component is attachable to the squeegee including a handle that includes a handle head on a front end side and a grip on a rear end side, a back plate attached to a front side of the handle head, a channel holding a rubber and clamped between the handle head and the back plate, wherein the squeegee attachment portion is provided inside of an area in which the handle head and the back plate overlap each other and the washer attachment portion is provided outside of the area, in a state in which the washer attachment component is attached to the squeegee, wherein both the squeegee attachment portion and the washer attachment portion are provided at spaced apart positions provided directly on an elongated main body of the washer attachment component that extends in the elongated direction.

* * * * *